US011827393B2

(12) United States Patent
Magri et al.

(10) Patent No.: US 11,827,393 B2
(45) Date of Patent: Nov. 28, 2023

(54) MACHINE AND METHOD FOR STABILISING PALLETISED LOADS

(71) Applicant: A.C.M.I.—SOCIETA' PER AZIONI, Fornovo di Taro (IT)

(72) Inventors: Giacomo Magri, Corniglio (IT); Giorgio Oppici, Rubbiano di Solignano (IT)

(73) Assignee: A.C.M.I.—SOCIETA' PER AZIONI, Fornovo di Taro (IT)

( * ) Notice: Subject to any disclaimer, the term of this patent is extended or adjusted under 35 U.S.C. 154(b) by 0 days.

(21) Appl. No.: 17/538,088

(22) Filed: Nov. 30, 2021

(65) Prior Publication Data

US 2022/0169407 A1 Jun. 2, 2022

(30) Foreign Application Priority Data

Dec. 2, 2020 (IT) ..... 102020000029396

(51) Int. Cl.
*B65B 41/04* (2006.01)
*B65B 11/04* (2006.01)
*B65B 61/06* (2006.01)

(52) U.S. Cl.
CPC ..... *B65B 11/045* (2013.01); *B65B 41/04* (2013.01); *B65B 61/06* (2013.01)

(58) Field of Classification Search
USPC ..... 53/461
See application file for complete search history.

(56) References Cited

U.S. PATENT DOCUMENTS 4,458,467 A 7/1984 Shulman et al.
5,351,461 A * 10/1994 Fandard ..... B65B 11/585 53/157
5,447,008 A * 9/1995 Martin-Cocher ..... B65B 11/025 53/399
2010/0025517 A1 2/2010 Cere
(Continued)

FOREIGN PATENT DOCUMENTS

CA 2276122 C * 11/2008 ..... B65B 11/025
DE 3150627 A1 10/1982
(Continued)

*Primary Examiner* — Chinyere J Rushing-Tucker
(74) *Attorney, Agent, or Firm* — Browdy and Neimark, PLLC

(57) ABSTRACT

A machine (100) and a method for stabilising palletised loads (900) are described, comprising: a functional arrangement (105) provided with a reel (110) on which a covering tape (800) is wound, a gripping device (350) adapted to take a first end of the covering tape (800) wound on the reel (110) and to make it integral with the palletised load (900), a first movement apparatus (215) adapted to generate a relative motion of revolution of the functional arrangement (105) around the palletised load (900), according to a predetermined revolution axis (Z), a second movement apparatus (275) adapted to generate a relative motion of translation of the functional arrangement (105) with respect to the palletised load (900) in a direction parallel to the revolution axis (Z), a cutting device (115) placed in the functional arrangement (105) so as to separate the covering tape (800) from the reel (110), a fixing device (400) adapted to fix at least a second end of the covering tape (800) to the palletised load (900).

24 Claims, 21 Drawing Sheets

(56) References Cited

U.S. PATENT DOCUMENTS

| | | | | |
|---|---|---|---|---|
| 2013/0081360 | A1* | 4/2013 | Smith | B65B 11/025 53/493 |
| 2014/0013707 | A1* | 1/2014 | Murarotto | B65B 59/04 53/203 |
| 2014/0217258 | A1* | 8/2014 | Cere' | B65B 11/025 104/118 |

FOREIGN PATENT DOCUMENTS

| | | | |
|---|---|---|---|
| DE | 3906873 | A1 | 9/1989 |
| GB | 2059906 | A | 4/1981 |
| IT | MO20090032 | A1 | 8/2010 |
| IT | 201800002676 | A1 | 8/2019 |

* cited by examiner

MACHINE AND METHOD FOR STABILISING PALLETISED LOADS

TECHNICAL FIELD

The present invention relates to a machine and a method for stabilising palletised loads, i.e. for stably blocking one or more loads above a pallet.

BACKGROUND

A currently very common way for stabilising palletised loads is to wrap them with a stretch film tape.

In practice, the stretch film tape is unwound from a reel and, after being subjected to an elongation step, conventionally called pre-stretch, is wound as a spiral around the palletised load, so as to form a complete wrapping.

Thanks to the pre-stretch step, the stretch film tape spontaneously tends to recover at least part of its initial shape, forming an envelope that adheres to the palletised load and binds it tightly.

But the stretch film is commonly made of polymeric material and consequently has a high environmental impact.

One possibility to reduce the environmental impact connected to the stabilisation of palletised loads could be to replace the stretch film tape with a tape made of recyclable and/or biodegradable material, for example a cellulose-based material like paper.

However, a material of this type has the drawback of being inextensible, so that it cannot adhere to the palletised load in the same way as the polymeric film tapes outlined above.

DISCLOSURE OF THE INVENTION

In light of the foregoing, an object of the present invention is to make available a method and a machine which allow to stabilise palletised loads even with a tape made of inextensible material, for example but not necessarily with a tape of a cellulose-based material like paper.

Another object is to achieve the aforesaid objective in the context of a rational and low cost solution.

These and other objects are achieved thanks to the characteristics of the invention reported in the independent claims. The dependent claims outline preferred and/or particularly advantageous aspects of the invention but not strictly necessary for the implementation thereof.

In particular, an embodiment of the present invention makes available a machine for stabilising palletised loads, comprising:

- a functional arrangement provided with a reel on which a covering tape is wound,
- a gripping device adapted to take a first end of the covering tape wound on the reel and to make it integral with the palletised load,
- a first movement apparatus adapted to generate a relative motion of revolution of the functional arrangement around the palletised load, according to a predetermined revolution axis,
- a second movement apparatus adapted to generate a relative motion of translation of the functional arrangement with respect to the palletised load in a direction parallel to the revolution axis,
- a cutting device placed in the functional arrangement so as to separate the covering tape from the reel,
- a fixing device adapted to fix at least a second end of the covering tape to the palletised load.

Thanks to the presence of the gripping device and of the fixing device which block the ends of the covering tape to the palletised load, it is advantageously possible to generate a stable envelope whatever the material of the covering tape.

In particular, it is possible to wrap and stabilise the palletised load also with a tape made of inextensible material and, preferably, with a tape of a cellulose-based material, for example but not necessarily of paper, i.e. of any other biodegradable and/or recyclable material, thereby allowing a reduction in the environmental impact connected with the stabilisation of palletised loads.

According to an aspect of the invention, the machine can comprise a rest surface for the palletised load and an upper pad, superimposed on said rest surface, which is adapted to stay in contact with the top of the palletised load.

In this way, during the winding steps, the palletised load is stably retained between the pad and the rest surface, preventing the lateral thrusts generated by the winding of the covering tape from causing displacements and possible falls of the load.

The pad can simply be placed on the top of the palletised load or it can be pressed with a certain force towards the rest surface.

An aspect of the invention provides that the gripping device can be installed on the upper pad.

This location allows a particularly convenient and simple installation of the gripping device.

According to another aspect of the invention, the gripping device can comprise a gripper member which is adapted to seize the first end of the covering tape and which, with respect to the relative motion of revolution of the reel around the palletised load, is adapted to remain integral with the palletised load.

This gripper member provides a particularly simple solution for blocking the first end of the covering tape to the palletised load, at least until the first windings are completed.

The gripping device may further comprise actuator members adapted to move said gripper member in a predetermined sliding direction towards and away from the revolution axis.

In this way, the first end of the covering tape can be gripped at a certain distance from the palletised load and subsequently brought close to the latter, ensuring that also the first windings of the covering tape are tight around the palletised load.

According to another aspect of the invention, the first movement apparatus can comprise a platform, which makes the rest surface available for the palletised load, and actuator members adapted to put said platform in rotation around a rotation axis coincident with the revolution axis.

Thanks to this solution, the revolution movement of the functional arrangement is obtained indirectly, i.e. it is the palletised load which, being put in rotation by the platform, rotates on itself, while the functional arrangement remains substantially stationary in a predetermined position.

In this way, the aforesaid revolution movement is carried out quite simply.

In this context, the upper pad (if any) could simply be dragged into rotation by the palletised load with which it is in direct contact.

More preferably, the first movement apparatus can however comprise further actuator members adapted to put the upper pad in rotation around a rotation axis coincident with the revolution axis.

This prevents the palletised load, especially when defined by a stack of separate objects, from twisting and possibly losing stability, especially during the initial acceleration step.

Another aspect of the invention provides that the machine may also comprise lifting members adapted to bring the upper pad closer to and away from the rest surface along a direction parallel to the revolution axis.

Thanks to these lifting members, the machine can be advantageously adjusted to be used with palletised loads of different heights, furthermore the upper pad can possibly be pushed with a certain force towards the rest surface.

According to another aspect of the invention, the cutting device can comprise at least one blade and actuator members adapted to move said blade with respect to the covering tape unwinding from the reel.

The use of this movable blade represents a particularly simple and reliable solution for separating the covering tape that has been wound on the palletised load from the reel from which it comes.

Another aspect of the invention provides that the functional arrangement may also comprise a blocking device positioned between the reel and the cutting device, for selectively blocking the covering tape unwinding from the reel.

This blocking device facilitates the cutting operation and, after the latter has been performed, it retains the portion of the covering tape which remains joined to the reel.

The blocking device may comprise a pair of plates and actuator members adapted to create a relative movement of said plates between a distanced configuration, in which the covering tape passes with clearance between said plates, and a neared configuration, in which the covering tape is clamped between said plates.

These plates, which generally define a sort of press, represent a particularly simple and reliable solution for blocking the covering tape during the cutting operation.

According to another aspect of the invention, the functional arrangement can comprise an advancement device positioned between the reel and the cutting device, for unwinding the covering tape from the reel and advancing it towards the cutting device.

This advancement device is useful, after the cutting operations have been performed, to advance the portion of covering tape that has remained joined to the reel, making available a first end that can be seized by the gripping device, to start winding a new palletised load.

The advancement device may in particular comprise a motorised drive roller adapted to drag the covering tape coming from the reel.

This drive roller represents a rather simple and effective solution for causing the covering tape to advance before it is seized by the gripping member.

The drive roller preferably has a rotation axis parallel to the rotation axis of the reel.

In this way it is avoided that the covering tape, sliding between the reel and the drive roller, can twist or be subjected to transverse thrusts which, especially in the case of an inextensible tape, could cause tears and/or breakages.

The advancement device may further comprise a contrast roller parallel to the drive roller and actuator members adapted to create a relative movement of said drive roller and said contrast roller between a distanced configuration, in which the covering tape passes with clearance between the drive roller and the contrast roller, and a neared configuration, in which the covering tape is clamped between the drive roller and the contrast roller.

This contrast roller, when in neared configuration, ensures that the covering tape is pressed into contact with the drive roller, which is then able to make it advance. When, on the other hand, it is in a distanced configuration, the contrast roller allows the covering tape to slide freely, for example during the winding of the palletised load, without being hindered or in any case influenced by the presence of the drive roller.

According to another aspect of the invention, the functional arrangement can comprise a brake for braking the rotation of the reel.

This brake has the function of preventing that, during the winding of the palletised load, the reel can unroll faster than necessary, which could make the winding slack and, consequently, unable to stabilise the palletised load.

In addition or alternatively, the functional arrangement may also comprise a motor for putting the reel in rotation.

This motor can be used to wind the covering tape onto the reel, before the operations of stabilisation of the palletised load begin.

According to a further aspect of the invention, the second movement apparatus can be configured to allow a variation in the orientation of the functional arrangement by rotation around an oscillation axis perpendicular to the revolution axis. Thanks to this solution, the reel (which is installed in the functional arrangement) can be oriented so that the rotation axis thereof is always perpendicular to the direction, typically spiral-like, with which the covering tape winds the palletised load following the joint action of the revolution movement and the translational movement of the functional arrangement, avoiding the onset of transversal tensions which, especially in the case of an inextensible tape, could cause tearing or obtaining a winding that is not perfectly adherent to the palletised load.

A further aspect of the invention provides that the functional arrangement can comprise a single rigid frame connected to the second movement apparatus, on which both the reel and the cutting device, and possibly the blocking device, the advancement device and the other accessory devices mentioned above (if any) are installed.

Thanks to this solution, a compact functional arrangement is obtained which can be manipulated more easily by the second movement apparatus and on which the position between the various devices remains constant, ensuring maximum efficiency and functionality.

In practice, all the movements imparted by the second movement apparatus to the reel are performed also by the cutting device, and by the other accessory devices referred to above, which therefore always remain in the optimal arrangement with respect to the reel.

In this context, the second movement apparatus can comprise for example a serial manipulator, preferably with five or six axes, to whose terminal the rigid frame is fixed.

This serial manipulator represents a particularly robust, efficient and reliable solution for moving the reel and all the other devices associated with the rigid frame in the space surrounding the palletised load.

Alternatively, the second movement apparatus can comprise:

- a guide column,
- a carriage slidingly associated with said guide column in a direction parallel to the revolution axis, and
- an articulated arm with parallel axes having a first end articulated to the carriage and a second end connected to the rigid frame.

In this way, the second movement apparatus is substantially configured as a SCARA robot, generally cheaper and simpler than a serial manipulator.

To allow this SCARA robot to orient the reel with respect to the previously mentioned oscillation axis, the second movement apparatus can further comprise an articulated joint adapted to connect the rigid frame to the second end of the articulated arm, said articulated joint defining an articulation axis coincident with the oscillation axis.

According to an alternative embodiment of the invention, the functional arrangement can comprise a first rigid frame carrying the cutting device (and possibly the blocking device, the advancement device and the supporting element, if any), a second rigid frame carrying the reel, and an articulated arm with parallel axes having a first end articulated to the first rigid frame and a second end articulated to the second rigid frame.

In this way, the functional arrangement assumes a more complex configuration which nevertheless allows the first frame, in which the free end of the covering tape is located, to move with respect to the second frame, in which the reel is located.

Consequently, while the first frame can be displaced close to the palletised load, the second frame can remain in the most appropriate position with respect to the second movement apparatus, to obtain a better weight balance and therefore to allow the use of comparably larger reel.

In this context, the second movement apparatus can therefore simply comprise:

- a guide column, and
- a carriage slidingly coupled to said guide column in a direction parallel to the revolution axis, to which the first rigid frame of the functional arrangement is connected.

In order to orient the reel with respect to the oscillation axis mentioned above, this second movement apparatus can further comprise an articulated joint adapted to connect the carriage to the second rigid frame of the functional arrangement, said articulated joint defining an articulation axis coincident with the oscillation axis. Regardless of all these considerations, a different aspect of the invention provides that the device for fixing the second end of the covering tape can comprise at least a first dispensing gun adapted to dispense a first adhesive between the second end of the covering tape and the palletised load.

Thanks to the use of an adhesive it is advantageously possible to fix the second end of the covering tape without the risk of mechanically damaging the palletised load.

In this case the first adhesive can preferably be a hot glue.

In fact, hot glue has the property of acting more quickly than other types of adhesives.

Another aspect of the invention provides that the fixing device may further comprise at least a second dispensing gun adapted to dispense a second adhesive between each winding of the covering tape and the palletised load.

In this way it is advantageously possible to make the entire envelope obtained with the covering tape more stable, consequently improving the stability of the palletised load.

In this case, the second adhesive can preferably be a cold glue.

In this way, the second dispensing gun and the relative adhesive feeding system can be simpler.

Although in the previous discussion reference has always been made to adhesives, it is not excluded that, in other embodiments, the first and/or the second adhesive dispensing gun may be replaced by a staple gun, a nail gun, a banding device or other.

Regardless of this, an embodiment of the present invention provides that the fixing device can be placed in the functional arrangement which also comprises the reel and the cutting device.

Thanks to this solution, the second movement apparatus is advantageously able to also move the fixing device and to position it suitably with respect to the palletised load.

According to an alternative embodiment, the fixing device can be associated with a third movement apparatus adapted to move it at least in a direction parallel to the revolution axis.

In this way, the movement of the fixing device is independent from that of the reel and of the cutting device, consequently obtaining greater precision and effectiveness.

According to another aspect of the invention, the machine can comprise at least two interchangeable functional arrangements, each of which is provided with a reel and with a cutting device, and a service apparatus adapted to house said functional arrangements, which is provided with means for winding the covering tape onto the respective reels.

The covering tape can in fact be supplied by the manufacturer in large-sized reels, incompatible with the overall dimensions of the functional arrangement and with the weights that can be supported by the second movement apparatus. Therefore, the functional arrangement can be provided with its own smaller and lighter reel that however must be periodically "replenished" with the covering tape.

Thanks to the solution described above, while one of the functional arrangements is installed on the second movement apparatus to perform the stabilisation operations of the palletised loads, the other one can be in the service apparatus so that the respective reel can be replenished with covering tape, after that the functional arrangements can be exchanged, allowing the machine to continue to operate with reduced downtime.

Alternatively, instead of interchangeable functional arrangements, the machine could comprise at least two interchangeable reels and a service apparatus adapted to house said reels and provided with means for winding the covering tape thereon.

In this way it is possible to achieve the same previous effect with lower costs and resources.

Finally, another embodiment of the present invention makes available a method for stabilising palletised loads, comprising the steps of:

- preparing a reel on which a covering tape is wound,
- taking a first end of the covering tape wound on the reel and making it integral with the palletised load,
- generating a relative motion of revolution of the reel around the palletised load, according to a predetermined revolution axis,
- generating a relative motion of translation of the reel with respect to the palletised load in a direction parallel to the revolution axis,
- separating the covering tape from the reel,
- fixing at least a second edge of the covering tape to the palletised load.

This embodiment of the invention substantially achieves the same effects as the machine outlined above, in particular that of allowing the stabilisation of palletised loads also by means of inextensible covering tapes, for example covering tapes of a cellulose-based material like paper.

Naturally, all the ancillary features mentioned above with reference to the machine are applicable mutatis mutandis also to the corresponding method.

BRIEF DESCRIPTION OF THE FIGURES

Further characteristics and advantages of the invention will become clear from reading the following description provided by way of non-limiting example, with the aid of the figures illustrated in the accompanying tables.

DETAILED DESCRIPTION

Figure 1:
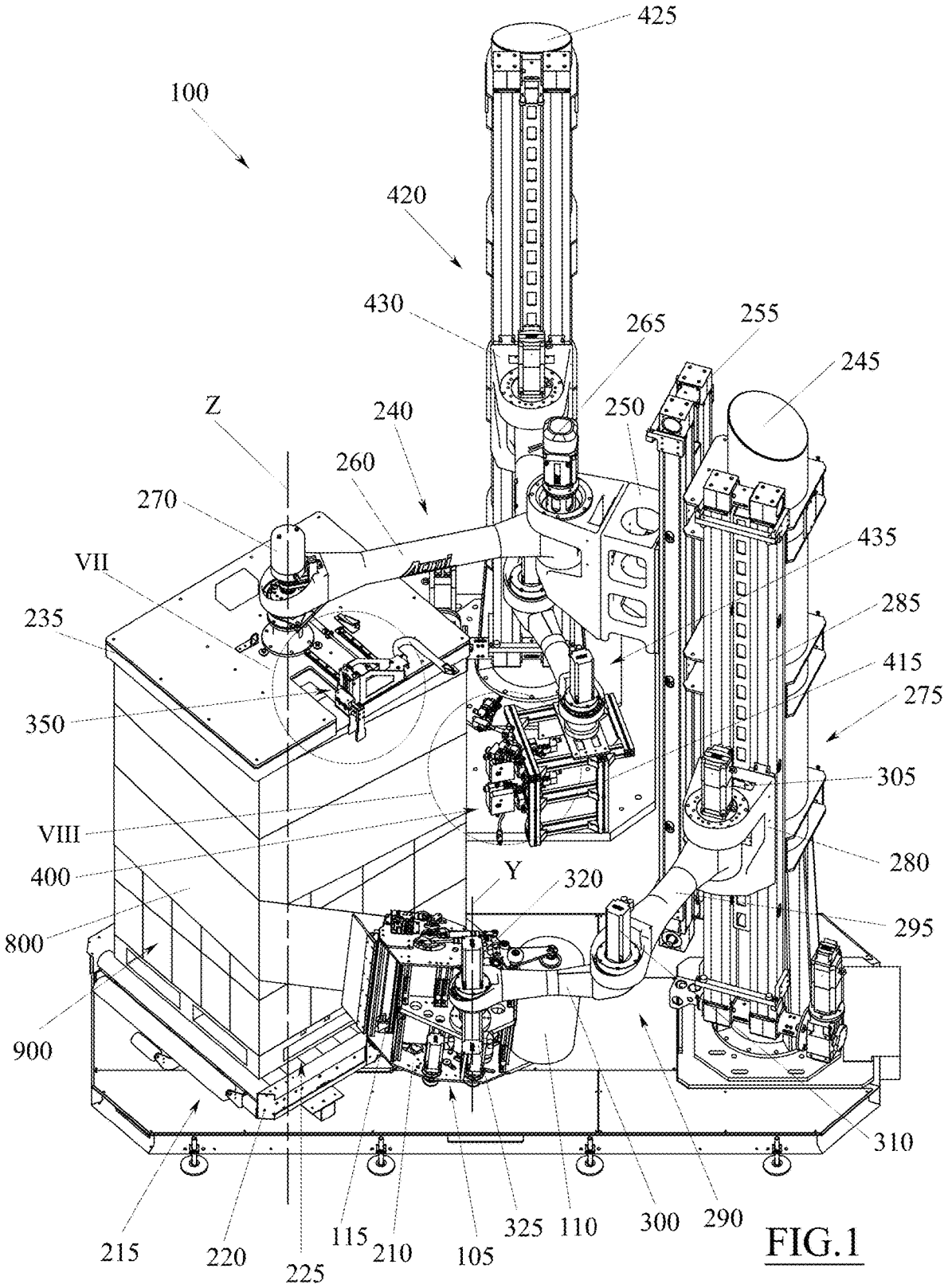
FIG. 1 is an axonometric view of a machine for stabilising palletised loads according to a first embodiment of the invention.

With the aid of FIGS. 1 to 12, a first example of a machine 100 for stabilising palletised loads 900 by wrapping with a covering tape 800 is described. A palletised load 900 is defined as an object or set of objects stacked above a pallet. Each object can in turn be composed of several elements, such as an arrangement of bottles or other containers joined together to form a bundle.

The covering tape 800 can be inextensible and can be made of a cellulose-based material, for example paper, or of any other recyclable and/or compostable material.

The machine 100 first of all comprises a functional arrangement 105 provided with a reel 110 on which the covering tape 800 is wound.

This reel 110 is rotatably associated with the functional arrangement 105, so as to be able to rotate on itself around a predetermined rotation axis A which generally coincides with the winding axis of the covering tape 800 on the reel 110 itself. A braking device (not illustrated), which is able to oppose a certain resistance to the rotation of the reel 110 around the respective rotation axis A, can be associated with the reel 110.

The functional arrangement 105 may further comprise a cutting device 115, which is adapted to cut the covering tape 800 unwinding from the reel 110, so as to separate a segment thereof.

Figure 6:
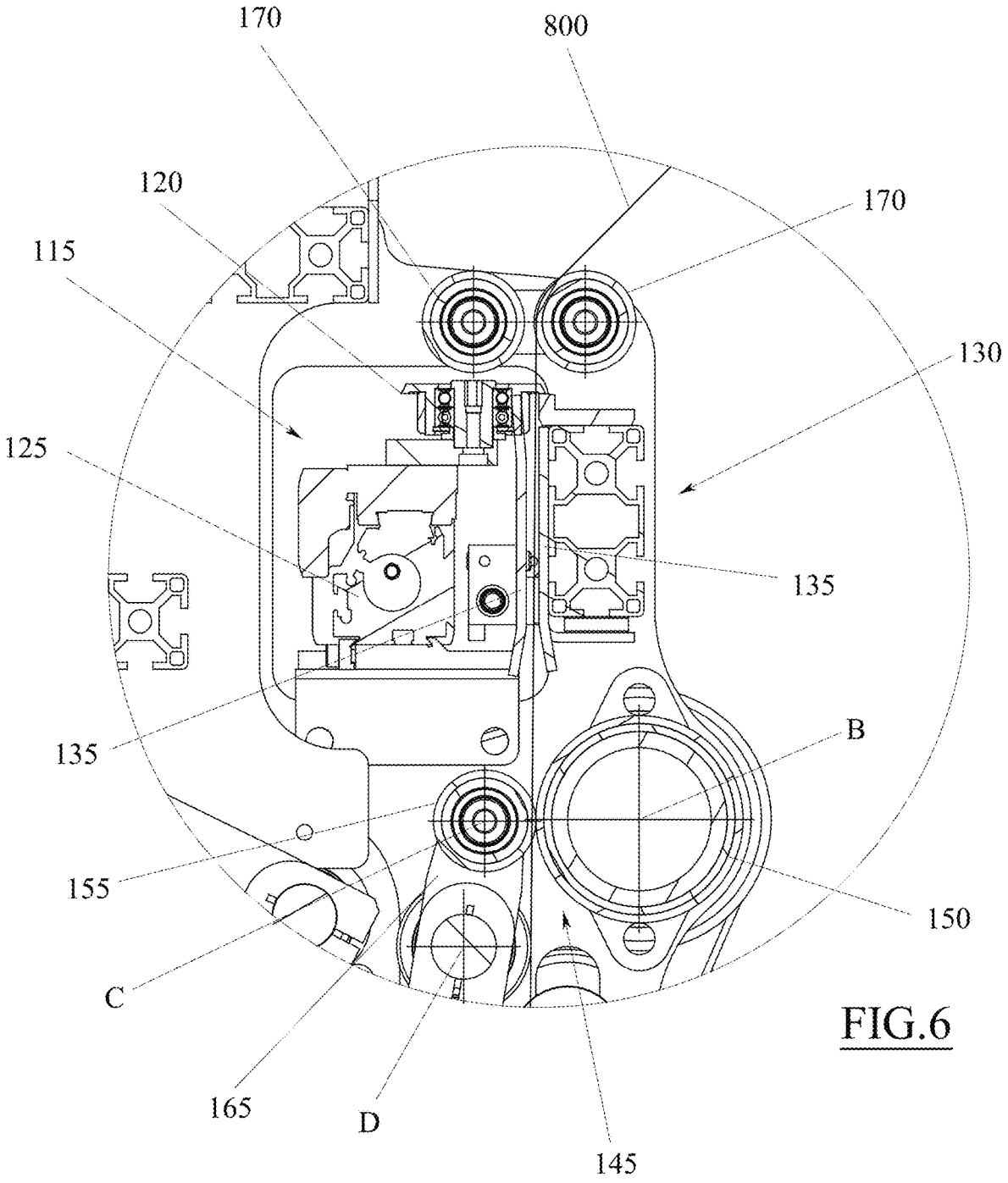
FIG. 6 is the detail VI of FIG. 5 shown in an enlarged scale.

As visible in the detail of FIG. 6, the cutting device 115 can comprise a blade 120, for example a rotating blade, and actuator members 125 adapted to move said blade 120 with respect to the covering tape 800 unwinding from the reel 110. In particular, the blade 120 can be driven for moving in a sliding direction parallel to the covering tape 800 but transversal, typically orthogonal, with respect to an advancement direction with which said covering tape 800 unwinds from the reel 110.

For example, the sliding direction of the blade 120 can be parallel to the rotation axis A of the reel 110.

In this way, the sliding of the blade 120 allows the covering tape 800 to be cut through along its entire width, subdividing it into two separate segments.

The actuator members 125 of the blade 120 can comprise a cylinder/piston arrangement of the pneumatic type or any other device, for example electromechanical, adapted to impose a linear type movement on the blade 120.

To allow an effective cutting of the covering tape 800, the functional arrangement 105 may also comprise a blocking device 130 which, with respect to the advancement direction of the covering tape 800, is positioned between the reel 110 and the cutting device 115.

In particular, the blocking device 130 is preferably placed near, for example substantially close to the blade 120 and is adapted to stably block the covering tape 800 to allow/facilitate the cutting action by the blade 120.

As is visible in particular in the detail of FIG. 6, this blocking device 130 can comprise a pair of plates 135, which are flat and mutually opposite each other, between which the covering tape 800 unwinding from the reel 110 passes.

These plates 135 can be associated with actuator members (not visible) adapted to engage them in a relative movement, for example in a direction orthogonal to the covering tape 800, between a distanced configuration and a neared configuration.

This relative movement can be obtained for example by keeping one of the two plates 135 stationary and by moving the other towards/away from the first one. When the plates 135 are in a distanced configuration (as illustrated in FIG. 6), the covering tape 800 passes through them with a certain clearance, thus resulting free to slide.

On the other hand, when the plates 135 are in a neared configuration (not illustrated), the covering tape 800 is stably blocked and clamped between the plates 135, which prevent it from advancing.

The actuator members of the plates 135 can comprise a cylinder/piston arrangement of the pneumatic type or any other device suitable for the purpose, for example of the electromechanical type.

In order to make the covering tape 800 advance after a cutting operation, the functional arrangement 105 may comprise an advancement device 145 which, with respect to the advancement direction of the covering tape 800, is preferably positioned between the reel 110 and the cutting device 115, for example upstream and/or close to the blocking device 130.

This advancement device 145 can comprise a drive roller 150 adapted to receive the covering tape 800 in contact, and a motor 140 (see FIG. 3) adapted to put the drive roller 150 in rotation around its central axis B.

The central axis B of the drive roller 150 is preferably parallel to the rotation axis A of the reel 110.

The advancement device 145 can further comprise a contrast roller 155, which is adapted to rotate on itself (typically in an idle way) around its own central axis C, and is adapted to press the covering tape 800 against the drive roller 150.

The central axis C of the contrast roller 155 is preferably parallel to the central axis B of the drive roller 150.

Finally, the advancement device 145 can comprise actuator members 160 (see FIG. 3) adapted to engage the drive roller 150 and the contrast roller 155 in a relative movement, for example in a direction transverse to the respective central axes B and C, between a distanced configuration and a neared configuration.

When the drive roller 150 and the contrast roller 155 are in a distanced configuration (not illustrated), the covering tape 800 passes through them with a certain clearance, thus being free to slide independently of the drive roller 150.

Figure 5:
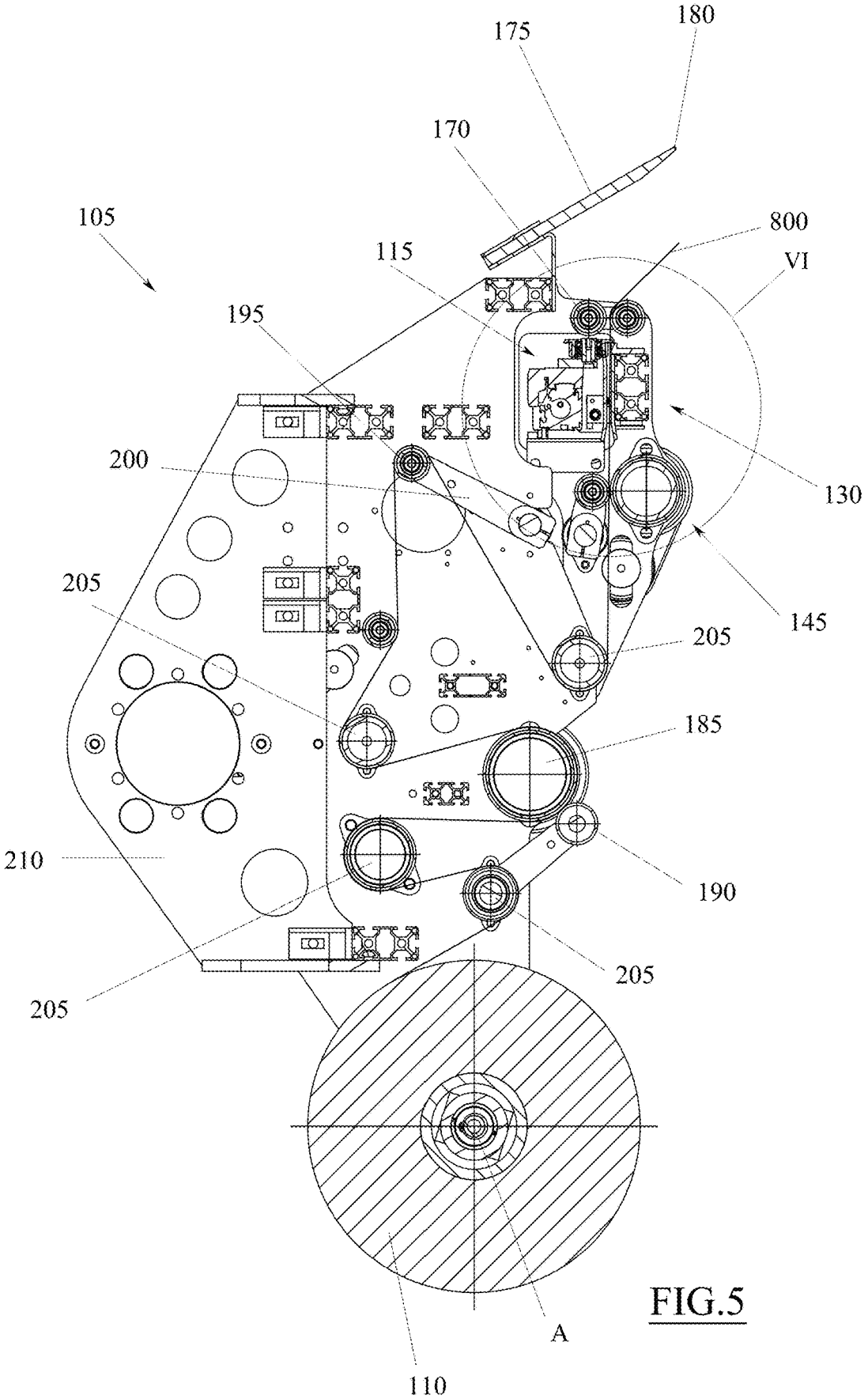
FIG. 5 is a section of the functional arrangement carried out according to the line V-V indicated in FIG. 3.

When, on the other hand, the drive roller 150 and the contrast roller 155 are in a neared configuration (as illustrated in FIGS. 5 and 6), the covering belt 800 is stably blocked and clamped between these two rollers, so that the sliding thereof in the advancement direction is generated by the rotation of the drive roller 150. This relative movement between the distanced position and the neared position can be obtained by keeping the drive roller 150 stationary and by moving only the contrast roller 155 towards/away from the drive roller 150.

For example, the contrast roller 155 can be rotatably coupled to at least one connecting rod 165, which is in turn adapted to rotate around a rotation axis D parallel but distanced with respect to the central axis C of the contrast roller 155 and to central axis B of the drive roller 150.

By making the connecting rod 165 rotate around the rotation axis D, the actuator members 160 are therefore capable of moving the contrast roller 155 towards/away from the drive roller 150.

These actuator members of the plates 160 can comprise for example a cylinder/piston arrangement of the pneumatic type or any other device suitable for the purpose, for example of the electromechanical type.

Downstream of the cutting device 115, with respect to the advancement direction of the covering tape 800, the functional arrangement 105 can comprise a pair of supporting rollers 170.

These supporting rollers 170 can be adapted to rotate on themselves (generally in an idle way), each around a respective axis parallel to the rotation axis A of the reel 110.

The supporting rollers 170 are neared between them but separated by a gap which is aligned with the advancement direction of the covering tape 800 through the cutting device 115.

For example, the gap between the supporting rollers 170 can be aligned with the gap formed between the plates 135 of the blocking device 130, when they are in a distanced configuration.

In this way, when the covering tape 800 is made to advance by the advancement device 145, after each cutting operation, the free end of the covering tape 800 passes in the gap between the supporting rollers 170, which guide it for sliding outwards, keeping it substantially stretched out.

The functional arrangement 105 can further comprise a spatula 175, which can be installed downstream of the cutting device 115, with respect to the advancement direction of the covering tape 800.

For example, the spatula 175 can be positioned on the opposite side of the cutting device 115 with respect to the position occupied by the advancement device 145.

The supporting rollers 170 (if any) can be positioned between the cutting device 115 and this spatula 175.

The spatula 175 can be shaped as a flat sheet, for example rectangular in shape, having at least one extremal edge 180 that extends parallel to the rotation axis A of the reel 110.

This spatula 175 can be positioned so as to ideally intersect the advancement direction with which the covering tape 800 passes through the cutting device 115. The spatula 175 can also be inclined with respect to said advancement direction, for example by an angle comprised between 0° and 90° (extremes excluded), preferably by an angle comprised between 20° and 70° (extremes included). The spatula 175 can be made of a flexible material, such as rubber.

Between the reel 110 and the advancement device 145, the functional arrangement 105 can then comprise one or more guide rollers, which are adapted to guide the covering tape unwinding from the reel 110 in a predetermined, more or less long and tortuous, path before reaching the advancement device 145 and from here the cutting device 115.

These guide rollers may also have rotation axes parallel to the rotation axis A of the reel 110.

In the example of FIG. 5, the guide rollers comprise at least one motorised drive roller 185, to which a respective contrast roller 190 is associated, operating in a manner similar to those described with reference to the advancement device 145.

Between the drive roller 185 and the advancement device 145, the guide rollers can further comprise at least one tensioning roller 195, which is rotatably coupled (generally in an idle way) to at least one support connecting rod 200 which, being adapted to oscillate rotating around an axis that is parallel but distanced from the axis of the tensioning roller 195, is capable of varying its position in order to keep the covering tape 800 at a certain tension.

The guide rollers can finally comprise one or more return rollers 205 positioned between the reel 110 and the drive roller 185 and/or between the drive roller 185 and the tensioning roller 195 and/or between the tensioning roller 195 and the advancement device 145, so as to make the path of the covering tape 800 more or less tortuous and long.

In this regard, it should be noted that the layout of the guide rollers illustrated in FIG. 5 corresponds to that currently used on the unwinders of machines designed to stabilise palletised loads with stretch film tapes, from which it follows that these unwinders can be retrofitted in order to be used in the present application, simply by adding the cutting device 115 and possibly the blocking device 130, the advancement device 145 and the spatula 175.

In the embodiment being examined, the functional arrangement 105 substantially comprises a single rigid frame 210, on which both the reel 110 and the cutting device 115, as well as possibly each of the other devices and apparatuses described above, including for example the blocking device 130, the advancement device 145 and the spatula 175, are installed.

In this way, the relative position of these devices on the rigid frame 210 is substantially fixed, and they are therefore constrained so as to move integrally with each other following any movement imparted to the rigid frame 210.

In other words, the functional arrangement 105 can be manipulated as a single rigid body.

In this regard, the machine 100 can comprise a first movement apparatus 215 adapted to produce a relative motion of revolution of the functional arrangement 105 around the palletised load 900, with respect to a predetermined, preferably vertical, revolution axis Z (see FIG. 1).

Relative motion of revolution means that the functional arrangement 105 rotates around the palletised load 900 with respect to a reference system integral with the palletised load 900, regardless of whether the actual movement is imparted to the functional arrangement 105 or to the palletised load 900.

Thus, for example, in the illustrated embodiment, the first movement apparatus 215 is actually adapted to put the palletised load 900 in rotation on itself.

For this purpose, the first movement apparatus 215 can comprise a platform 220, which makes a rest surface 225, preferably horizontal, available for the palletised load 900.

In particular, the rest surface 225 can be defined by a roller conveyor which, when installed on the platform 220, facilitates the positioning and subsequent distancing of the palletised load 900.

The first movement apparatus 215 further comprises actuator members (not illustrated) adapted to put the platform 220 in rotation around a rotation axis orthogonal to the rest surface 225 and coincident with the axis, for example substantially vertical, of revolution Z.

In particular, the rotation axis of the platform 220 can pass internally to the rest surface 225, so that the palletised load 900 can substantially pivot on itself.

In a position superimposed on the rest surface 225, the machine 100 can comprise an upper pad 235, which is adapted to stay in contact with the top of the palletised load 900.

This upper pad 235 can be substantially shaped as a flat plate, for example substantially rectangular/square in shape, and oriented horizontally.

The upper pad 235 can be associated with a lifting apparatus 240 adapted to move it in the vertical direction, so as to bring it closer to and away from the rest surface 225, for example to free the palletised load 900 or to adjust the position thereof according to the height of the latter.

This lifting apparatus 240 can comprise for example a supporting column 245 and a carriage 250 slidingly associated with the supporting column 245, so as to be able to slide on it in a vertical direction, driven by suitable motors.

In particular, the supporting column 245 can be provided with linear sliding guides 255, oriented vertically, on which corresponding coupling runners fixed to the carriage 250 slide.

The lifting apparatus 240 can further comprise a cantilevered, preferably horizontal, arm 260 which connects the carriage 250 to the upper pad 235.

To allow a correct positioning of the upper pad 235, one end of the cantilevered arm 260 can be articulated to the carriage 250 according to a vertical articulation axis, so that the cantilevered arm 260 can rotate like a flag.

This rotation of the cantilevered arm 260 can be driven by an electric motor 265. The upper pad 235 can also be adapted to rotate on itself around an axis of vertical rotation, which is coincident (or can be brought so as to be coincident) with the revolution axis Z.

For example, the upper pad 235 can be hinged, according to said rotation axis, to a second end of the cantilevered arm 260, and can be drive for rotation by a motor 270 or by any other actuator member.

In particular, it is preferable that the rotation of the upper pad 235 occurs substantially simultaneously and substantially at the same speed as the rotation of the platform 220, so that the palletised load 900 is not subjected to significant torsional stresses.

Although in the previous description reference has been made to a first movement apparatus 215 adapted to rotate the palletised load 900, it is not excluded that, in other embodiments, the palletised load 900 may remain stationary, for example resting on a rest surface 225 made available by a floor or any other fixed base, and that the first movement apparatus 215 is configured to actively move the functional arrangement 105 with a revolution movement around the palletised load 900.

Also in this case, the machine 100 could in any case comprise an upper pad 235 adapted to remain in contact and integral with the top of the palletised load 900 (in this case also stationary).

Regardless of these considerations, the machine 100 further comprises a second movement apparatus 275, which is adapted to produce a relative motion of translation of the functional arrangement 105 with respect to the palletised load 900, along a direction parallel to the revolution axis Z, or preferably in the vertical direction.

Relative motion of translation means that the functional arrangement 105 and the palletised load 900 are mutually movable in a direction parallel to the revolution axis Z, regardless of whether the actual movement is of one or the other.

Thus, for example, in the illustrated embodiment, the second movement apparatus 275 is adapted to actively move the functional arrangement 105 in the vertical direction, while the palletised load 900 remains stable on the rest surface 225. However, it is not excluded that, in other embodiments, the second movement apparatus 275 may be configured to move the palletised load 900 vertically, for example by lifting and/or lowering the corresponding platform 220.

In any case, the second movement apparatus 275 is preferably configured to also allow a displacement of the functional arrangement in a plane orthogonal to the revolution axis Z, that is in a preferably horizontal plane, as well as to allow a variation in the orientation of the functional arrangement 105, and consequently of the rotation axis A of the reel 110, through rotation around a further oscillation axis Y perpendicular to the revolution axis Z, that is preferably horizontal.

To obtain these degrees of freedom, the second movement apparatus 275 can first of all comprise a supporting column and a carriage 280 slidingly associated with said supporting column, so as to be able to slide vertically thereon, driven by suitable motors.

In the illustrated example, the supporting column of the second movement apparatus 275 can coincide with the supporting column 245 of the lifting apparatus 240 of the upper pad 235.

In particular, the supporting column 245 can be provided with linear sliding guides 285, oriented vertically, on which corresponding coupling runners fixed to the carriage 280 slide.

The second movement apparatus 275 can further comprise a cantilevered arm 290, preferably horizontal, which connects the carriage 280 to the functional arrangement 105, that is to the rigid frame 210.

The cantilevered arm 290 can be an articulated arm with parallel, for example all vertical, axes to allow a more efficient positioning of the functional arrangement 105.

In particular, the cantilevered arm 290 can comprise two stretches in series, of which a first stretch 295 articulated to the carriage 280 and a second stretch 300 articulated to the free end of the first stretch 295.

The rotation of the first stretch 295 with respect to the carriage 280 can be driven by an electric motor 305, while the rotation of the second stretch 300 with respect to the first stretch 295 can be driven by another electric motor 310.

In practice, the carriage 280 and the cantilevered arm 290 define a so-called SCARA robot.

Figure 4:
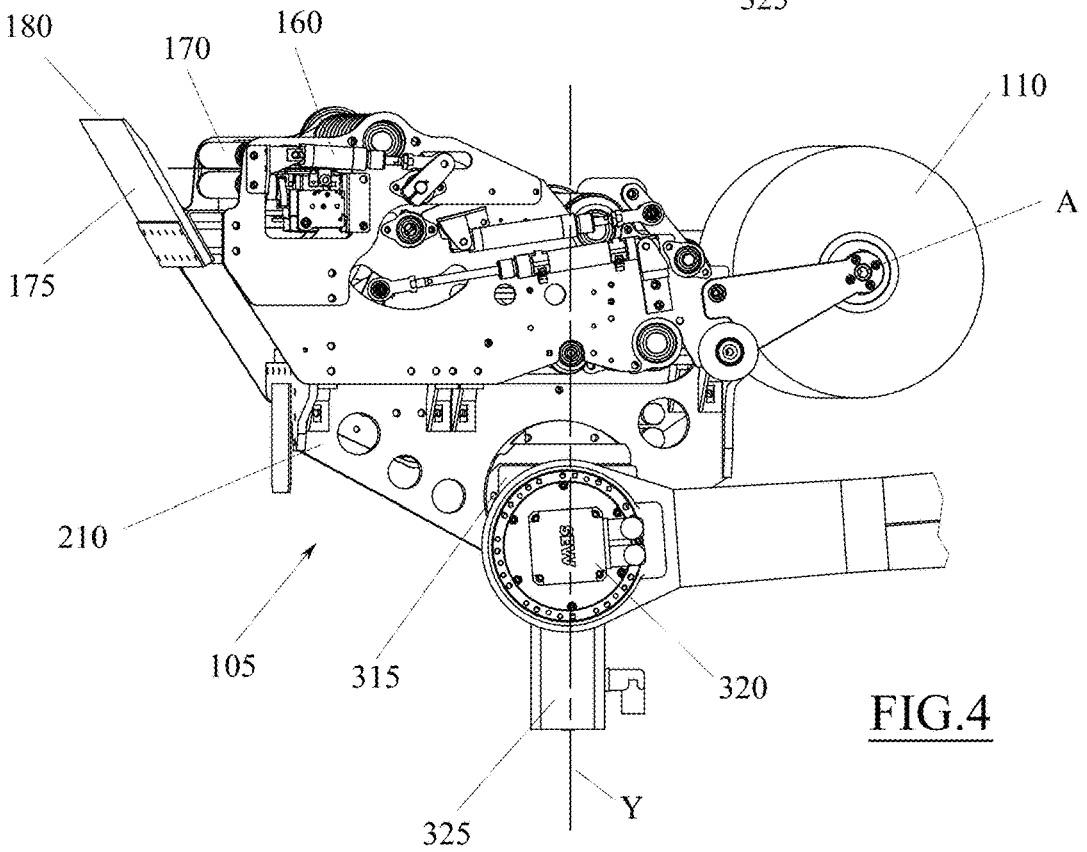
FIG. 4 is an enlarged detail of FIG. 2 showing the same functional arrangement.

The rigid frame 210 of the functional arrangement 105 can be connected to the cantilevered arm 290, i.e. to the free end of the second stretch 300, by interposition of an intermediate body 315 (see FIG. 4).

This intermediate body 315 can be articulated to the cantilevered arm 290 by means of an articulated joint which allows it to rotate around an articulation axis parallel to that defined between the cantilevered arm 290 and the carriage 250, i.e. preferably vertical.

The rotation of the intermediate body 315 with respect to this articulation axis can be driven by an electric motor 320.

The intermediate body 315 can then be articulated to the rigid frame 210 of the functional arrangement 105 by means of a further articulated joint which defines the already mentioned oscillation axis Y.

The rotation of the functional arrangement 105 with respect to this oscillation axis Y can be driven by a further electric motor 325.

The machine 100 further comprises a gripping device 350, which is adapted to seize a first end of the covering tape 800 unwinding from the reel 110 and to make it integral with the palletised load 900.

This gripping device 350 can be positioned at the base or, more preferably, at the top of the palletised load 900 and is adapted to remain integral with the latter during the relative revolution and translation movements of the functional arrangement 105.

For example, the gripping device 350 can be installed on the platform 220 or, more preferably, on the edge of the upper pad 235.

Figure 7:
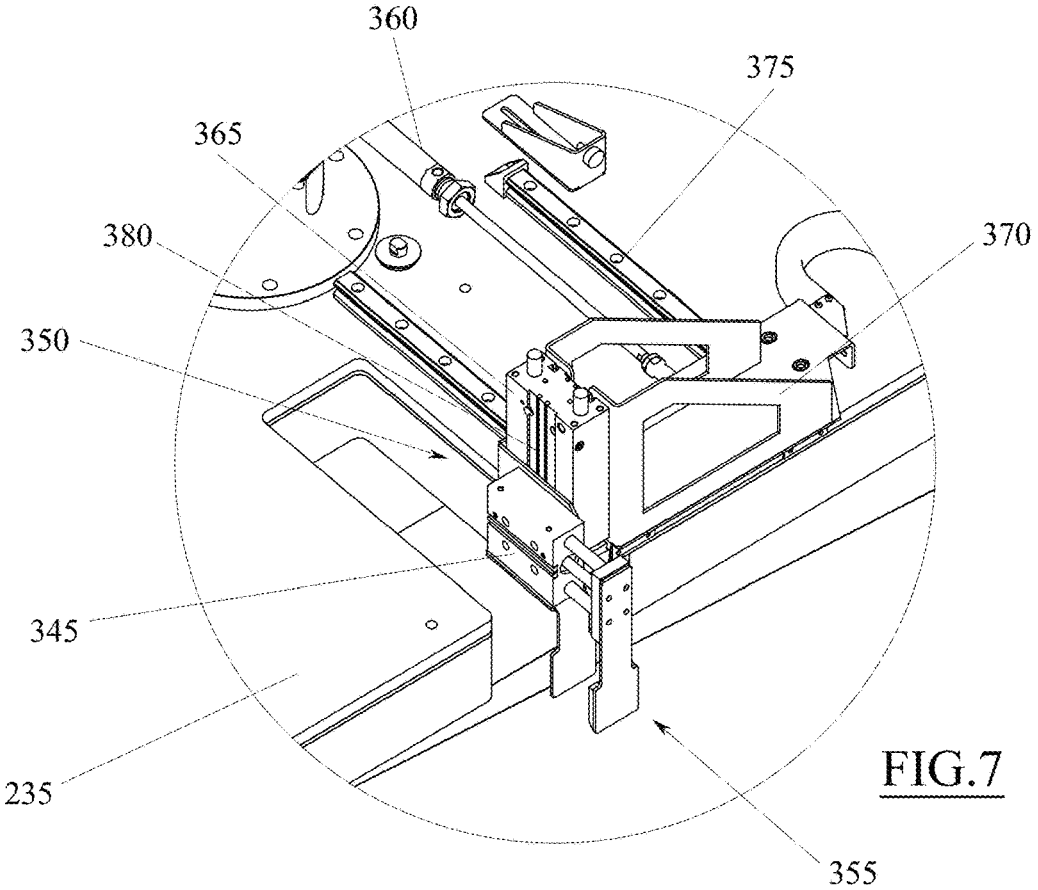
FIGS. 7 and 8 are respectively details VII and VIII of FIG. 1 shown on an enlarged scale.

As illustrated in FIG. 7, this gripping device 350 can comprise a gripper member 355 provided with at least two jaws that are reciprocally movable towards and away from each other, so as to be able to selectively clamp or release an edge of the covering tape 800 which is positioned between them.

This movement of the jaws of the gripper member 355 can be driven by means of a cylinder-piston arrangement 345 of the pneumatic type or by any other actuation system, for example electromechanical.

The jaws of the gripper member 355 can protrude at least slightly from the upper pad 235 towards the rest surface 225, so as to be at least partially flanked to the side wall of the palletised load 900.

The gripping device 350 can further comprise actuator members 360 adapted to move the gripper member 355 along a predetermined sliding direction, towards and away from the revolution axis Z, and therefore with respect to the side wall of the palletised load 900.

The sliding direction of the gripper member 355 can be orthogonal to the revolution axis Z, for example horizontal.

Other actuator members 365 can further be provided to move the gripper member 355 also in a direction parallel to the revolution axis Z.

In particular, the gripper member 355 can be positioned at a slot obtained in the upper pad 235, installed on board a carriage 370 which is slidingly coupled to linear guides 375, oriented parallel to the sliding direction, which can be fixed above the upper pad 235.

The actuator members 360 can comprise a cylinder-piston arrangement of the pneumatic type or any other type of actuator, for example electromechanical, adapted to make the carriage 370 slide on the linear guides 375.

On board the carriage 370 there may also be further linear guides 380, vertically oriented, to which the gripper device 355 is slidingly coupled.

The actuator members 365 may comprise another cylinder-piston arrangement of the pneumatic type or any other type of actuator, for example electromechanical, adapted to make the gripper member slide on the linear guides 380.

In addition to what has been described so far, the machine 100 further comprises a fixing device 400, which is adapted to fix the windings of covering tape 800 around the palletised load 900.

In the illustrated embodiment, this fixing device 400 comprises one or more guns for dispensing an adhesive adapted to be applied on the windings of the covering tape 800.

Figure 8:
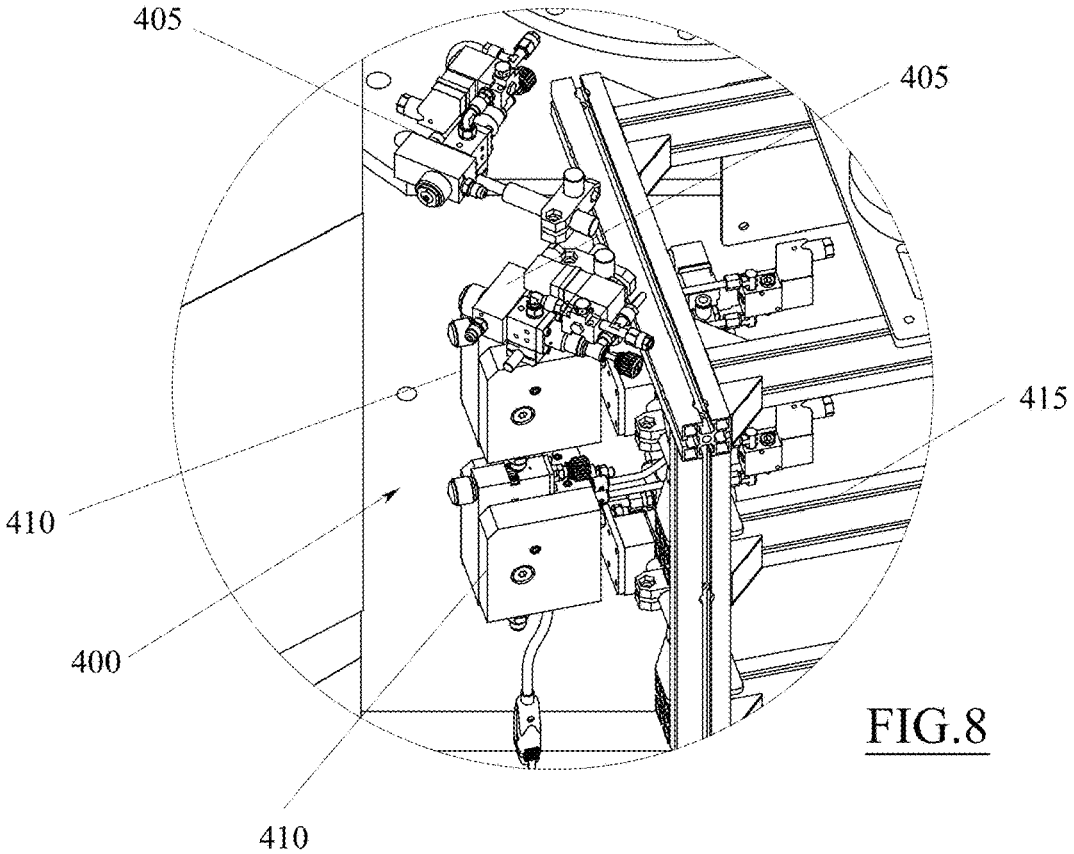

As illustrated in FIG. 8, these dispensing guns can comprise one or more dispensing guns 405 of a hot glue and, optionally, one or more dispensing guns 410 of a cold glue.

However, it is not excluded that, in other embodiments, the fixing device 400 may comprise only hot glue dispensing guns 405 or only cold glue dispensing guns 410.

Nor is it excluded that other embodiments may provide for replacing the adhesive dispensing guns with nail guns, staple guns, banding devices or any other device suitable for applying an element, substance or treatment that allows to join and/or to keep the windings of the covering tape 800 joined.

In any case, in the illustrated example, the fixing device 400 can be installed on a rigid frame 415, independent and separate from the rigid frame 210 of the functional arrangement 105.

The rigid frame 415 can be associated with a third movement apparatus 420, which is adapted to move the fixing device 400 at least along a direction parallel to the revolution axis Z, for example vertical, and, more preferably, also in multiple positions in the plane orthogonal to said revolution axis Z, so as to be able to suitably place it with respect to the palletised load 900.

For example, the third movement apparatus 420 can be configured as a SCARA robot, which comprises a supporting column 425, a carriage 430 slidingly associated with the supporting column 425, so as to move in a vertical direction (driven by suitable motors), and a cantilevered arm 435 adapted to connect the carriage 430 to the frame 415 of the fixing device 400.

The cantilevered arm 435 can be an articulated arm with parallel, for example all vertical, axes, which comprises a first stretch 440 articulated to the carriage 430 and a second stretch 445 articulated to the first stretch 440 and to the rigid frame 415 of the fixing device 400.

Each of these joints can be driven by a respective independent electric motor.

In the light of what has been described above, the operation of the machine 100 is described below with reference to FIGS. 9 to 13.

Initially, the palletised load 900 is loaded onto the rest surface 225 and the upper pad 235 is brought into contact with the top thereof, possibly causing it to exert a certain downward pressure.

While the palletised load is stationary in this position, the functional arrangement 105 can be oriented, by means of the second movement apparatus 275, in such a way that the rotation axis A of the reel 110 and thus the orientation of the covering tape 800 are substantially parallel to the revolution axis Z, i.e. substantially vertical.

Again by means of the second movement apparatus 275, the functional arrangement 105 can be brought close to the palletised load 900 and at the gripping device 350, so that a first (free) end of the covering tape 800 associated with the reel 110, i.e. the one protruding downstream of the cutting device 115, can be vertically aligned with the gripper member 355.

At this point, the gripper member 355 can be lowered, so that said first end of the covering tape 800 slips between the jaws thereof, which are subsequently clamped together in order to seize it and hold it firmly.

Subsequently, the gripper member 355 can be moved towards the revolution axis Z, dragging therewith the covering tape 800 (which therefore begins to unwind from the reel 110), until it is positioned in the immediate vicinity of the side wall of the palletised load 900.

Figure 9:
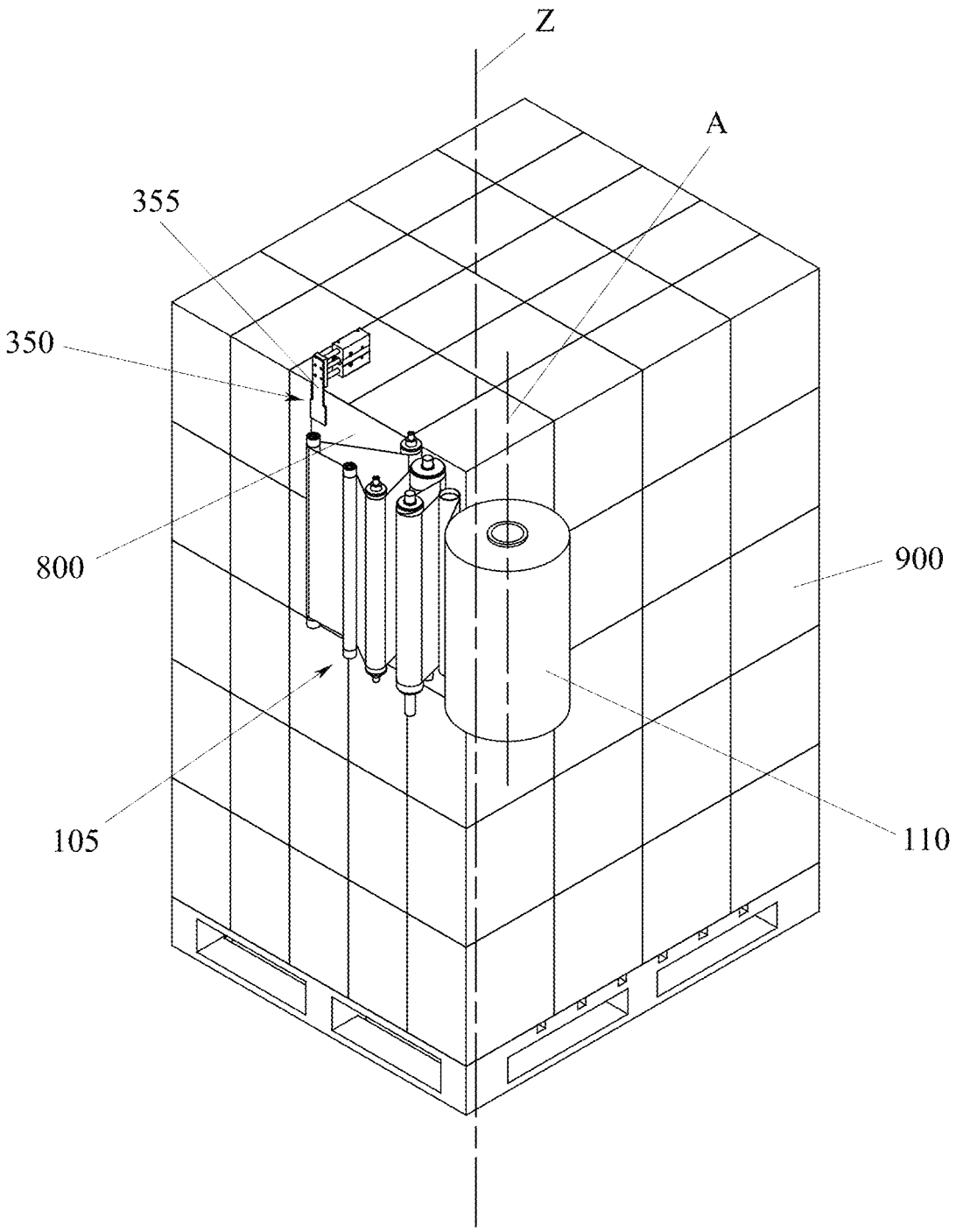
FIGS. 9 to 12 illustrate as many steps of the stabilisation process of a palletised load by means of the machine of FIG. 1.

It should be observed that in FIG. 9, the cutting device 115 and the spatula 175 are not illustrated for clarity reasons.

At the end of this step, the platform 220 and the upper pad 235 can be put in rotation around the revolution axis Z, by correspondingly activating the rotation of the palletised load 900 as well.

In this way, the reel 110 which is on board the functional arrangement 105 begins to perform a relative revolution movement around the palletised load 900.

During this revolution movement, since the first end of the covering tape 800 remains integral with the palletised load 900, the covering tape 800 is automatically dragged so as to unwind from the reel 110 and to wind around the palletised load 900.

In this step, the advancement device 145 of the functional arrangement 105 is inactive, for example with the drive roller 150 stationary and the contrast roller 155 in a distanced configuration.

At the same time, it is instead preferable that in this step the rotation of the reel 110 is at least partially braked, so that the covering tape 800 remains suitably stretched.

The first windings of covering tape 800 can be perfectly horizontal and mutually superimposed at the top band of the palletised load 900.

After these first windings, the gripping device 350 can optionally release the first end of the covering tape 800 which remains integral with the palletised load 900 thanks to the windings.

Thereafter, while the palletised load 900 continues to rotate, the second movement apparatus 275 can begin to displace the functional arrangement 105 in a vertical downward direction.

Figure 10:
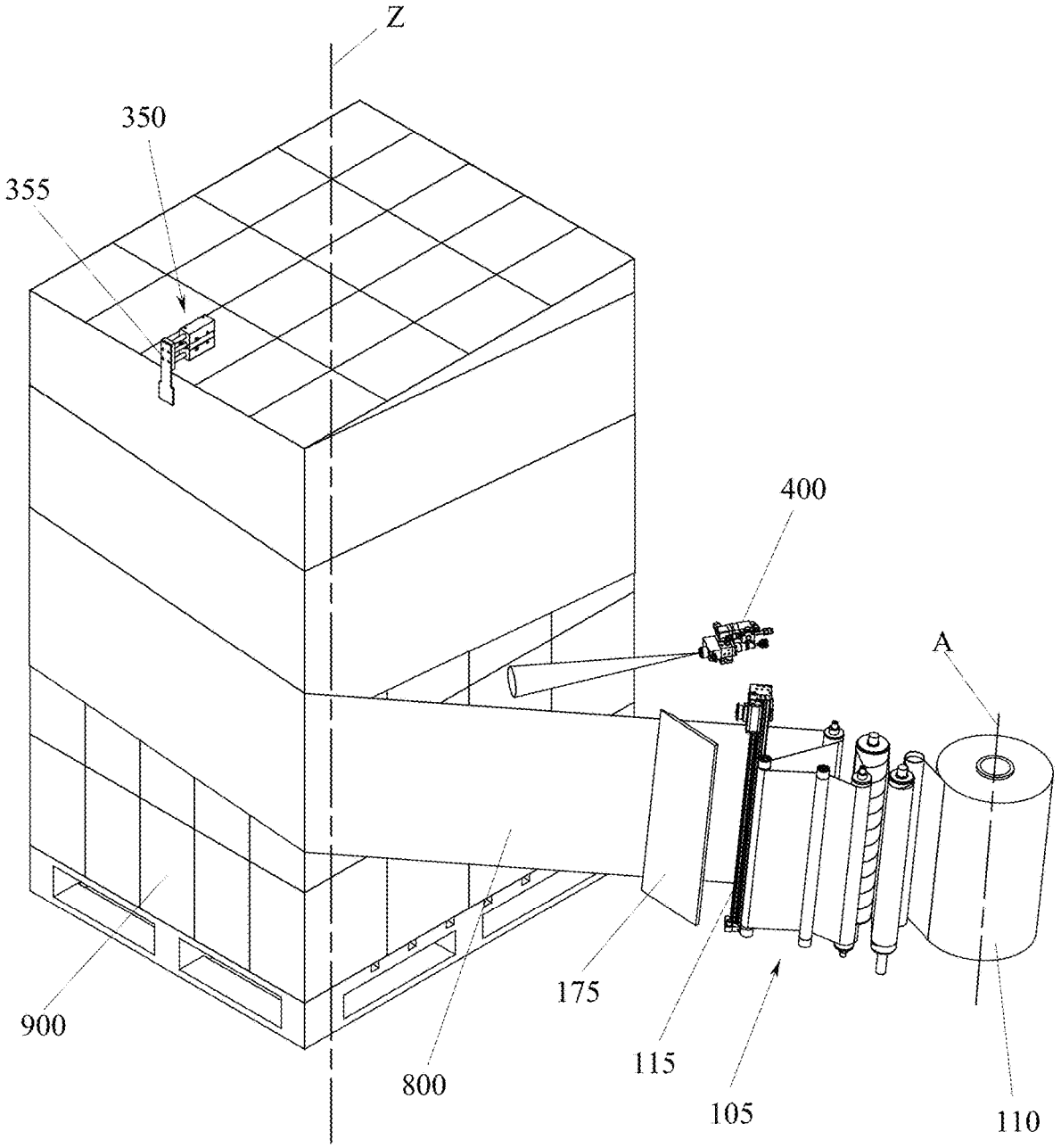
Figure 11:
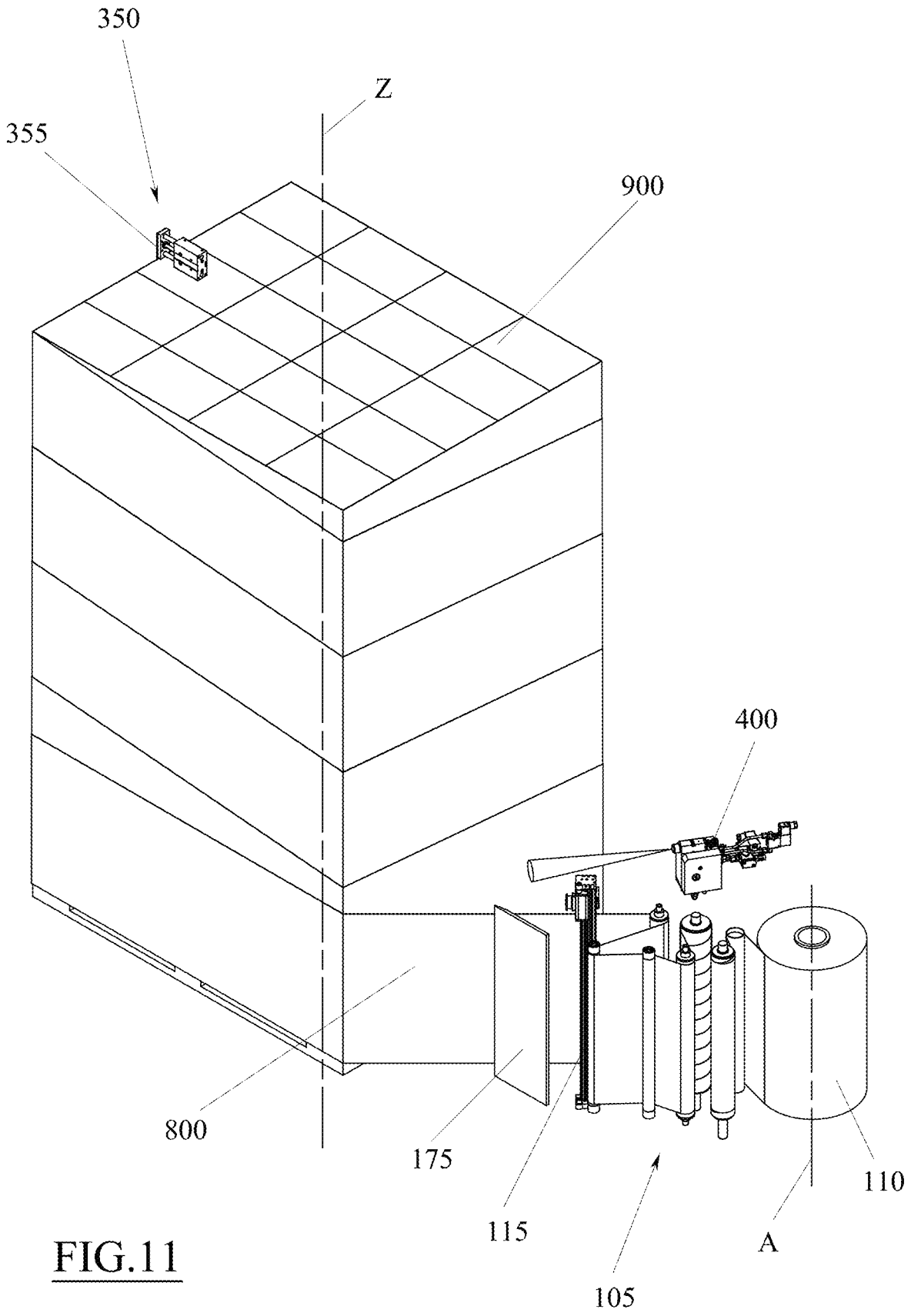

In this way, the covering tape 800 is wound around the palletised load 900 with a spiral course, until it completely covers the side wall (see FIG. 10).

Since the covering tape 800 can be substantially inextensible, in order to accompany this spiral course, the second movement apparatus 275 orients the functional arrangement 105, by making it rotate around the oscillation axis Y (or allowing it to rotate around the oscillation axis Y), in such a way that the rotation axis A of the reel 110 always remains substantially orthogonal to the direction of the helix.

During each rotation of the palletised load 900, the dispensing guns of the fixing device 400 can dispense (e.g. spray) a certain amount of adhesive onto the winding of the covering tape 800 that has been previously made, so that said adhesive remains interposed between the previous winding and the one being made, joining them together and making the wrapping more stable.

In particular, the adhesive used in this step can be the cold glue dispensed by the dispensing guns 410.

At the base of the palletised load 900 (see FIG. 11), the translational movement of the functional arrangement 105 is stopped and it can be made to rotate around the oscillation axis Y, so as to bring back the rotation axis of the reel 110 vertically.

At this point it is possible to make a few final windings of the covering tape 800, with a horizontal course and perfectly overlapping one another, at the base of the palletised load 900.

At the end of this step, the platform 220 and the upper pad 235 can be stopped. The dispensing guns of the fixing device 400 can therefore be commanded for dispensing (e.g. spraying) a certain amount of adhesive onto the portion of the envelope facing the last stretch of the covering tape 800 coming from the reel 110.

The adhesive used in this step can be the hot glue dispensed by the dispensing guns 405, as it is characterized by shorter setting times than the cold glue.

Through the second movement apparatus 275, the functional arrangement 105 can then be approached to the palletised load 900 (see FIG. 12), so as to begin to bring the last stretch of the covering tape 800 coming from the reel 110 into contact with the palletised load 900, above the previously dispensed adhesive.

At the same time, the cutting device 115 comes into operation which separates the segment of covering tape 800 wound around the palletised load 900 from the one that remains connected to the reel 110.

In this way, the segment of covering tape 800 wound around the palletised load 900 will have a second free end, which can be stretched and pressed against the adhesive previously dispensed by means of the extremal edge 180 of the spatula 175 which, by means of the second movement apparatus 275, is brought into contact and suitably made to slide against the previously wrapped palletised load 900.

The segment of covering tape 800 which remains associated with the reel 110 will now have a new free end positioned at the cutting device 115, for example blocked by the blocking device 130.

Figure 12:
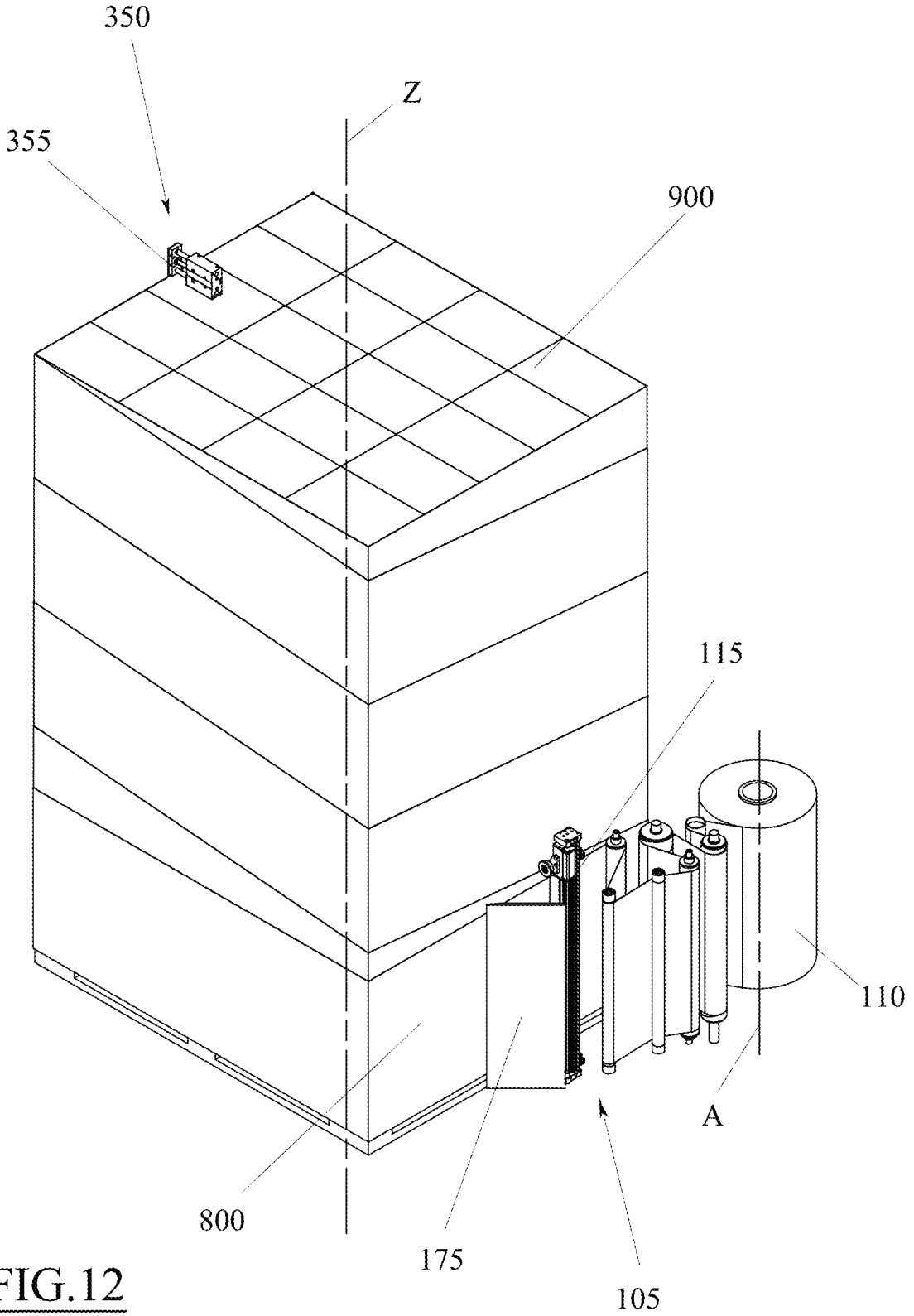

In order to make this free end protrude beyond the cutting device 115, for example beyond the supporting rollers 170, and thus make it available for stabilising another palletised load 900, the advancement device 145 can now be put into operation (not illustrated in FIG. 12).

In particular, the contrast roller 155 can be brought into contact with the drive roller 150 and the latter can be driven for rotation, so as to unwind at least a part of the covering tape 800 from the reel 110, thus making it advance until the free end will be sufficiently protruding to be seized again by the gripper member 355 of the gripping device 350.

The operation of the machine 100, as outlined above, can be entirely commanded and controlled by at least one electronic unit (not illustrated), which is suitably programmed and connected with the various devices and apparatuses of the machine 100.

Some alternative embodiments of the machine 100 are now described with the aid of FIGS. 13 to 21.

In order to avoid unnecessarily burdening the discussion, the common characteristics with the already described machine 100 will not be repeated but simply the differences thereof will be highlighted.

Figure 13:
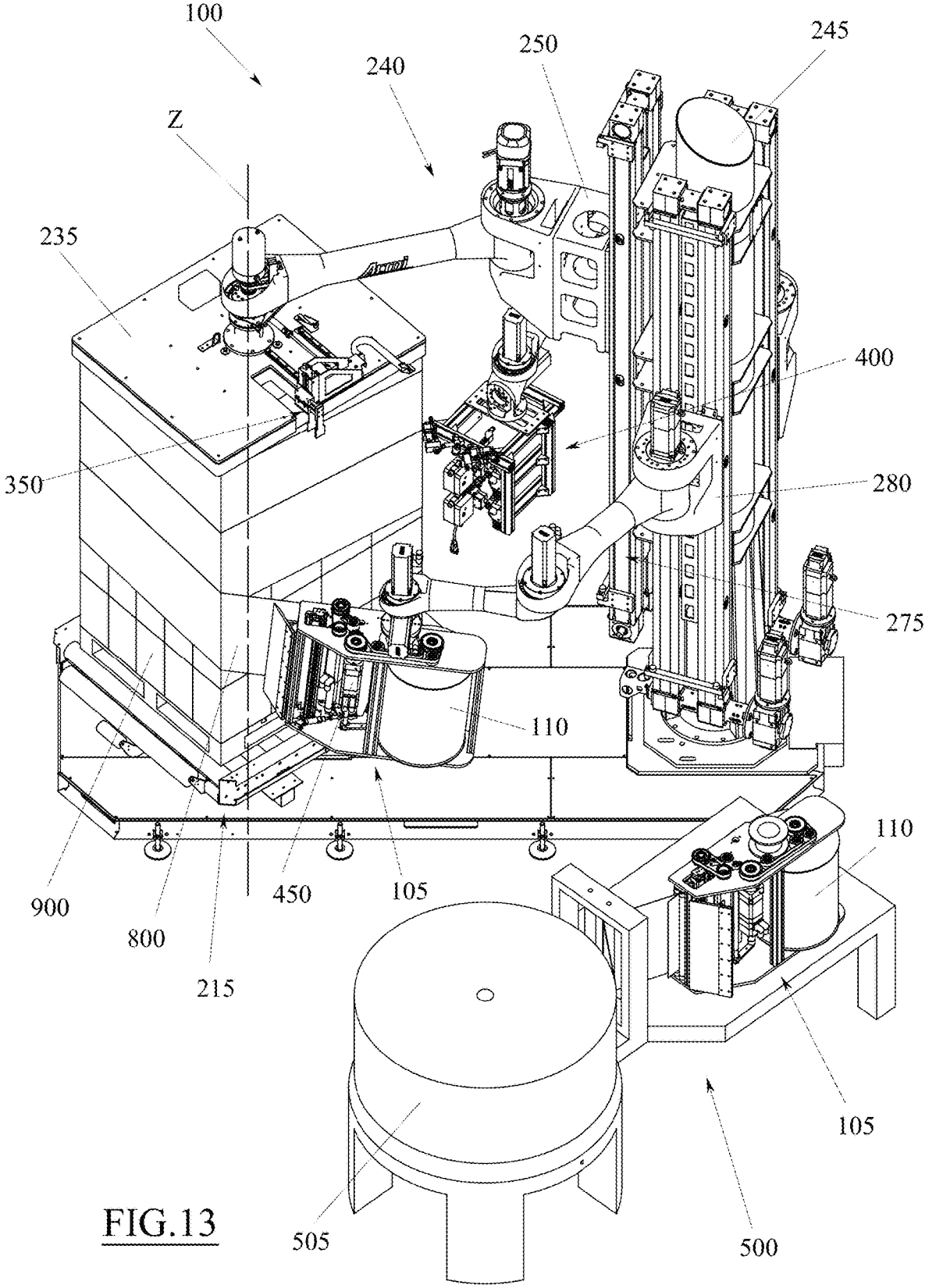
FIG. 13 is an axonometric view of a machine for stabilising palletised loads according to a second embodiment of the invention.
Figure 14:
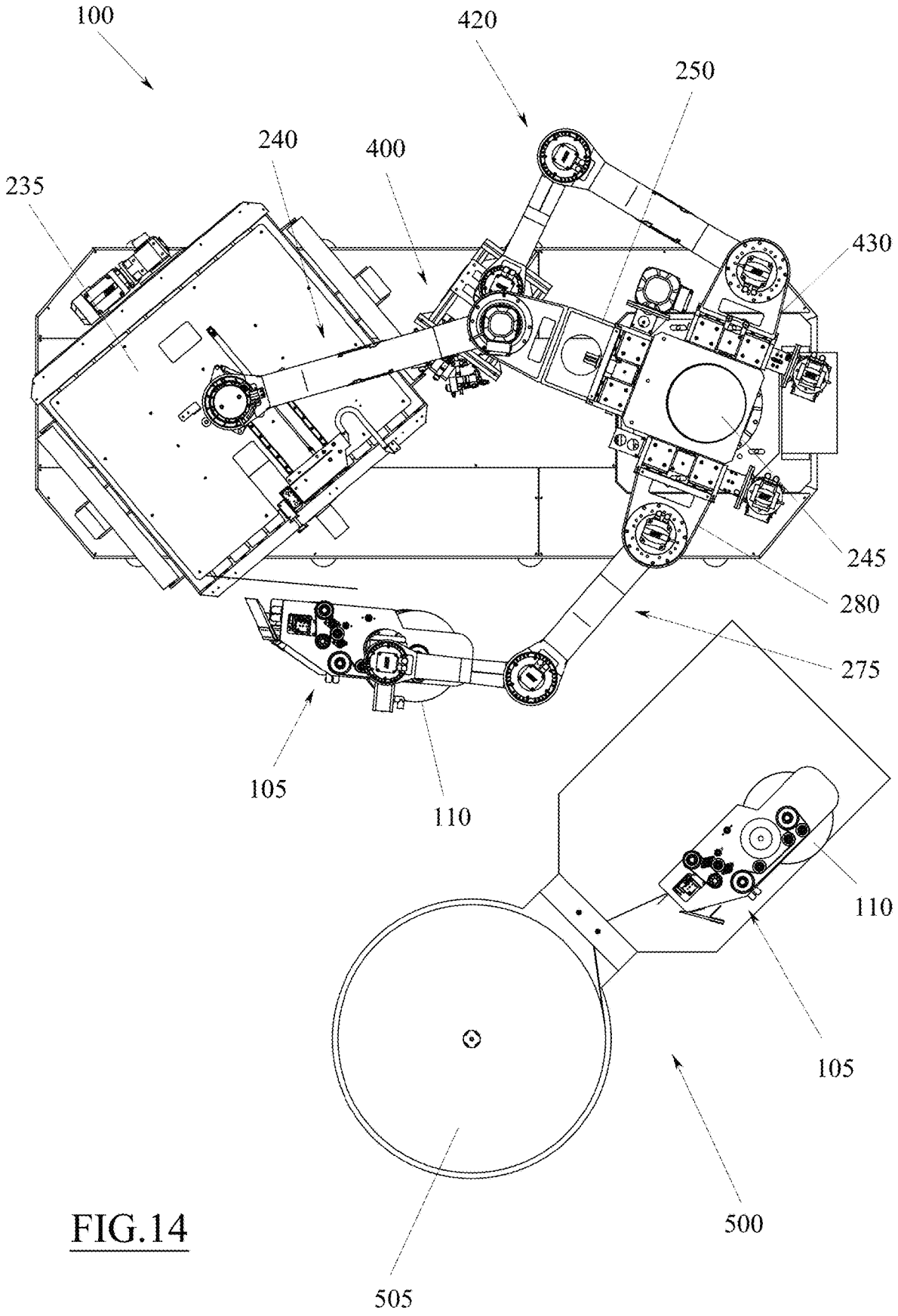
FIG. 14 is a top view of the machine of FIG. 13.
Figure 15:
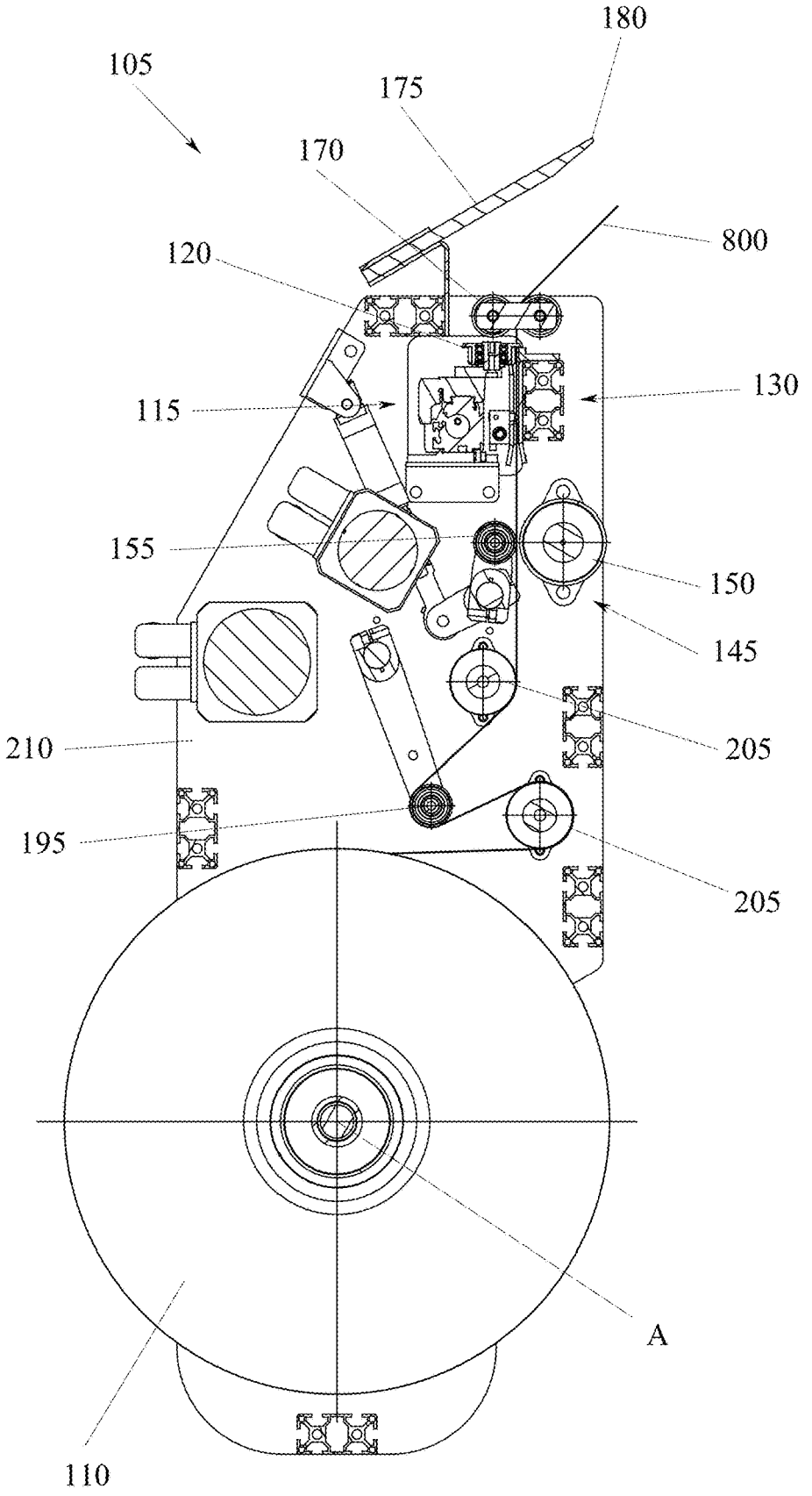
FIG. 15 is the section of the functional arrangement of the machine of FIG. 13 made according to the same sectional plane of FIG. 5.

The embodiment illustrated in FIGS. 13 to 15 is very similar to that already described, from which it differs in few aspects.

A first of these aspects is that the third movement apparatus 420 of the fixing device 400 shares the same supporting column 245 with the second movement apparatus 275 of the functional arrangement 105 and with the lifting apparatus 240 of the upper pad 235.

In other words, the carriage 430 of the third movement apparatus 420 is slidingly associated with the same supporting column 245 to which the carriages 250 and 280 respectively of the lifting apparatus 240 and of the second movement apparatus 275 are also slidingly associated.

The actuation of these carriages 250, 280 and 430 preferably remains independent of each other.

Another aspect of diversity consists in the fact that the functional arrangement 105 is simplified.

Also in this case, the functional arrangement 105 comprises a single rigid frame 210 on which the reel 110, the cutting device 115 and, possibly, the blocking device 130, the advancement device 145, the supporting rollers 170 and the spatula 175 are installed.

In this case, however, most of the guide rollers are absent, which take the form of just two return rollers 205 positioned between the reel 110 and the advancement device 145, and a single tensioning roller 195 positioned between said return rollers 205.

In this embodiment, the reel 110 is also motorised, that is, it is connected to a drive motor 450 (see FIG. 13) adapted to put it in rotation around its own rotation axis A.

The drive motor 450 can be part of the functional arrangement 105, for example installed on the rigid frame 210, and can be connected to the reel 110 via a belt or any other transmission system.

The function of the drive motor 450 is preferably to rotate the reel 110 in the winding direction, so as to rewind the covering tape 800 thereon.

In fact, it is envisaged that the machine 100 can comprise a service apparatus 500 adapted to house at least two mutually interchangeable functional arrangements 105, for example identical to each other, one of which can be connected in use to the second movement apparatus 275 while the other can be left in the service apparatus 500.

When the covering tape 800 wound on the reel 110 of the first functional arrangement 105 is finished, this first functional arrangement 105 can be stowed in the service apparatus 500 and immediately replaced with the second functional arrangement 105.

To allow this operation, the functional arrangement 105 can be connected to the second movement apparatus 275 by means of an automatic hooking and unhooking system.

When the first functional arrangement 105 is in the service apparatus 500, the respective reel 110 can be reloaded with the covering tape 800.

This covering tape 800 can for example be supplied by the manufacturer in large-sized reels 505, one of which can be rotatably installed at the service apparatus 500.

By means of a manual or more preferably automated system, the free edge of the covering tape 800 wound on this reel 505 can be made to pass backwards through the cutting device 130 and any other accessory devices of the first functional arrangement 105, to be finally connected to the respective reel 110.

The reel 110 can then be put in rotation by the motor 450 until it is reloaded with a desired number of windings of the covering tape 800, after which the cutting device 130 can be put into action to separate the segment of the winding tape 800. wound on reel 110 from that eventually still wound on the reel 505.

At this point, when the machine 100 has finished using the second functional arrangement 105, the second movement apparatus 275 can stow it back in the service apparatus 500, to be in turn reloaded as explained above, and pick up again the first functional arrangement 105 which in the meantime has already been reloaded.

Figure 16:
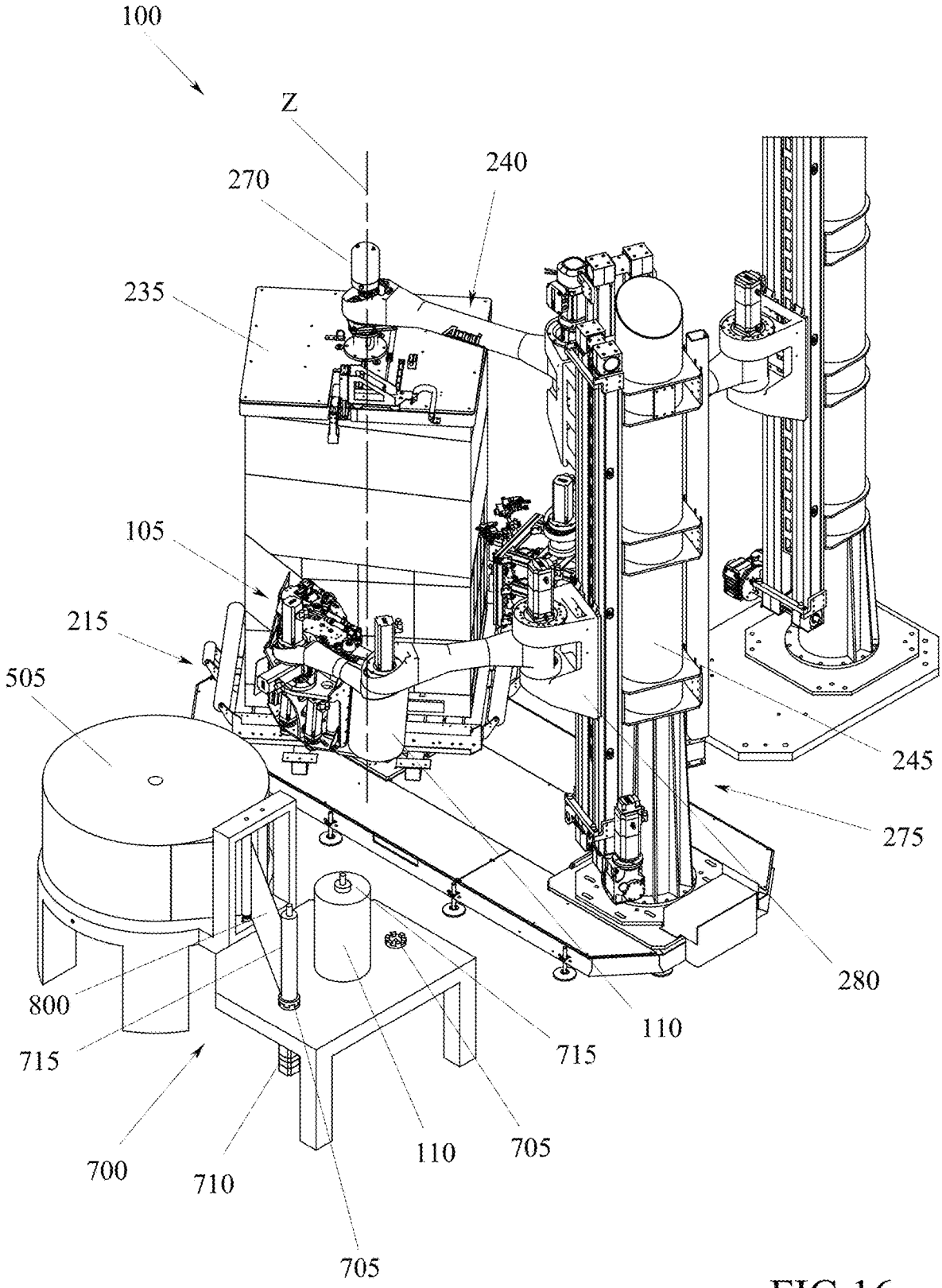
FIG. 16 is an axonometric view of a machine for stabilising palletised loads according to a third embodiment of the invention.
Figure 17:
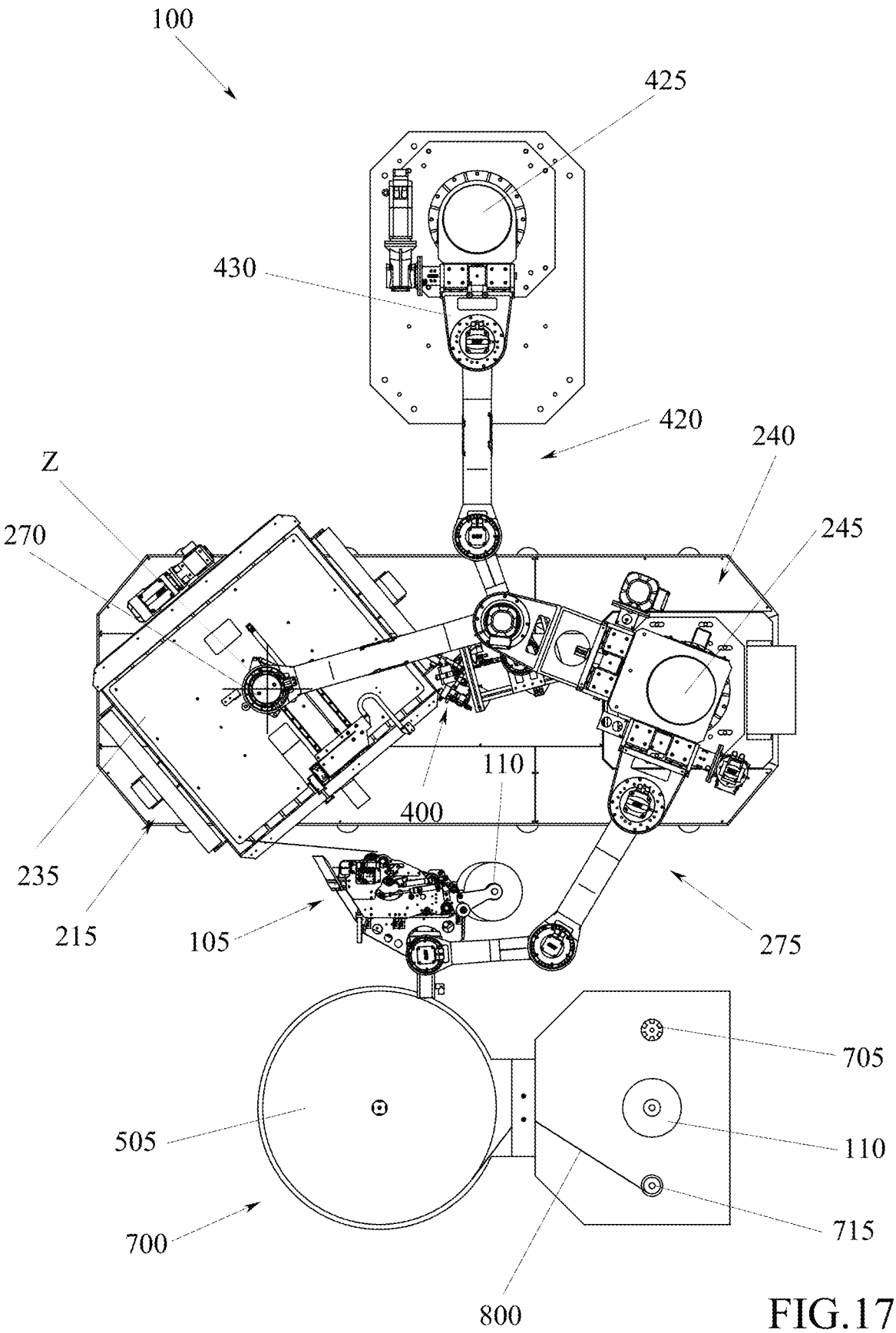
FIG. 17 is a top view of the machine of FIG. 16.

An alternative to this embodiment could be that illustrated in FIGS. 16 and 17, where, instead of replacing the entire functional arrangement 105, the machine 100 allows replacing, preferably in an automated way, the reel 110 only.

Figure 2:
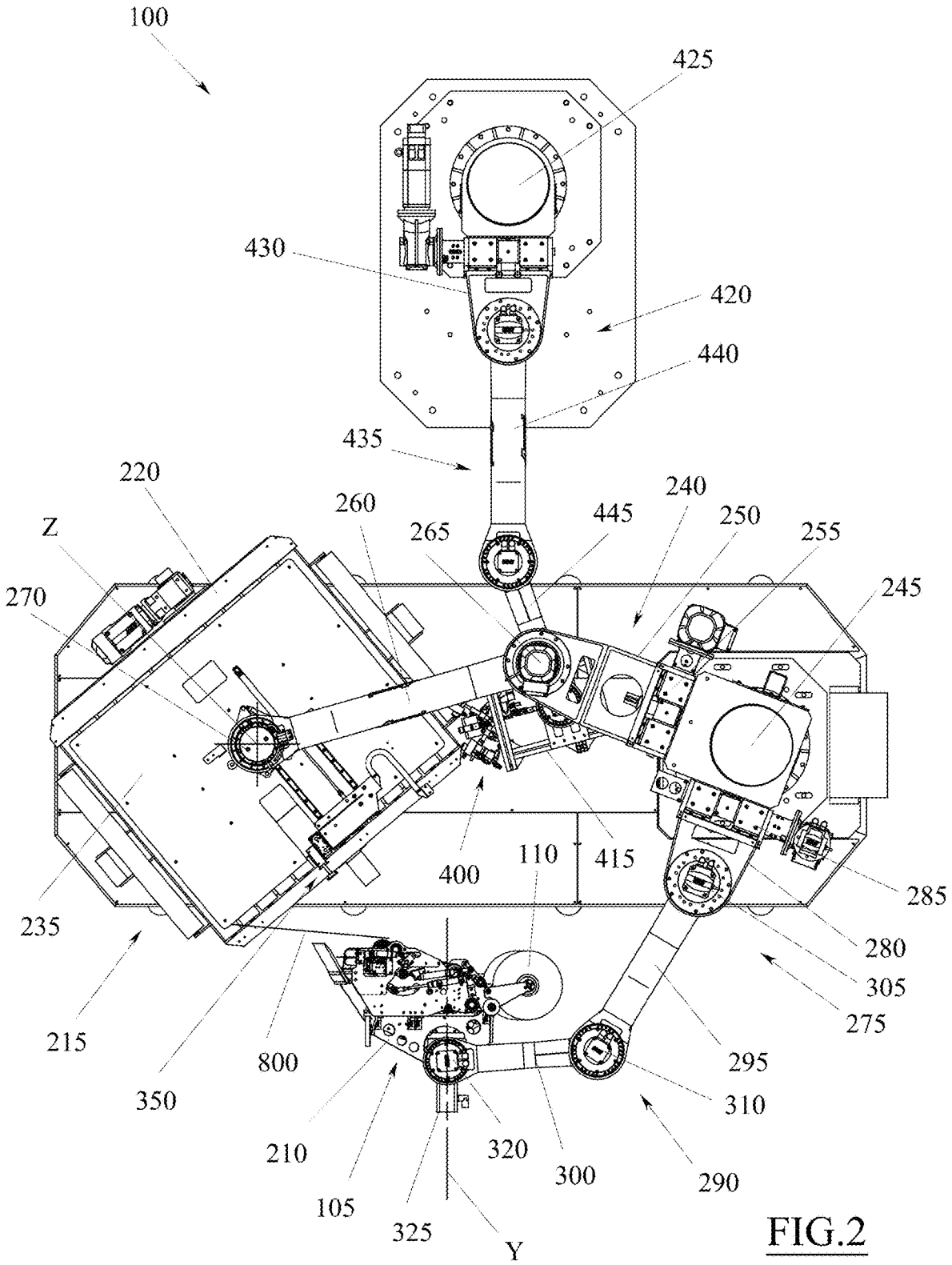
FIG. 2 is a top view of the machine of FIG. 1.
Figure 3:
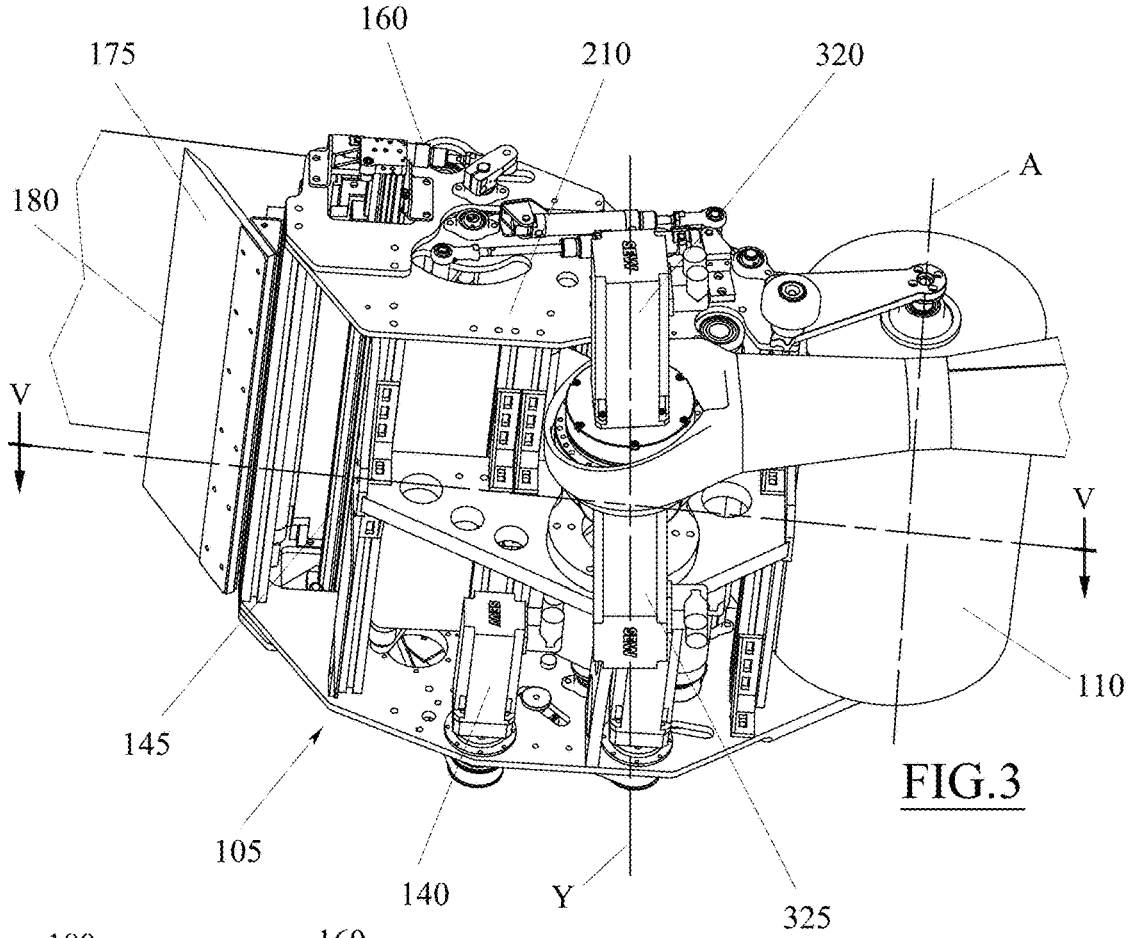
FIG. 3 is an enlarged detail of FIG. 1 showing the functional arrangement.

In this case, the machine 100 can be, for example, substantially identical to that illustrated in FIGS. 1 and 2, with the difference of comprising two or more interchangeable reels 110, for example identical to each other, a first of which can be connected in use in the functional arrangement 105 while the others can be left in a service apparatus 700.

When the covering tape 800 wound on the first reel 110 is finished, the functional arrangement 105 can release this reel 110 in the service apparatus 700 and pick up therefrom one of the other reels 110.

When the first reel 110 is in the service apparatus 700, the same can be reloaded with the covering tape 800.

In this way, when the machine 100 has finished using also the second reel 110, the latter can be released in the service apparatus 700 to be in turn reloaded, while the first reel 110, which in the meantime has been duly reloaded, can be rehooked to the functional arrangement 105.

To allow these operations, the functional arrangement 105 can comprise an automatic system for hooking and unhooking the reels 110.

The service apparatus 700 can comprise a plurality of spindles 705, each of which is adapted to receive a reel 110 and is put in rotation by a respective motor 710.

Each reel 110 may comprise a central shaft 715, for example made of steel, which engages on the spindle 705 when the reel 110 is released in the service apparatus 700.

The covering tape 800 is unwound from the reel 505 made available by the supplier and connected directly to the central shaft 715 which, by rotating together with the spindle 705, winds the covering tape 800 around itself.

Once the winding is finished, the reel 110 is then disengaged from the spindle 705 and finally hooked to the functional arrangement 105 together with its own central shaft 715.

Alternatively, instead of the central shaft 715, the reel 110 could comprise a cylindrical core, for example made of cardboard.

In this case, each spindle 705 could comprise a shaft, for example an expansion shaft, on which the cylindrical core of the reel 110 is fitted.

The covering tape 800 is then fixed to the cylindrical core which, by rotating together with the spindle 705, forms the reel 110.

Once the winding is finished, the reel 110 is then removed from the shaft of the spindle 705 and finally hooked to the functional arrangement 105 together with the respective cylindrical core.

After usage on board the functional arrangement 105, the cylindrical cores can be reused or replaced with new ones.

In this second case, the service apparatus 700 could also be used independently of the machine 100, for example to prepare a certain number of reels 110 which are then stored and used from time to time on the machine 100 when necessary, or for preparing reels of covering tape 800 useful for other purposes.

Regardless of the winding system used, it is always preferable for the service apparatus 700 to comprise a cutting device for separating the segment of winding tape 800 wound on the reel 110 from that eventually still wound on the supplier's reel 505.

Naturally, the presence of a service apparatus 500 or 700 and the relative methods of use can be envisaged in all the embodiments described in the present description.

Figure 18:
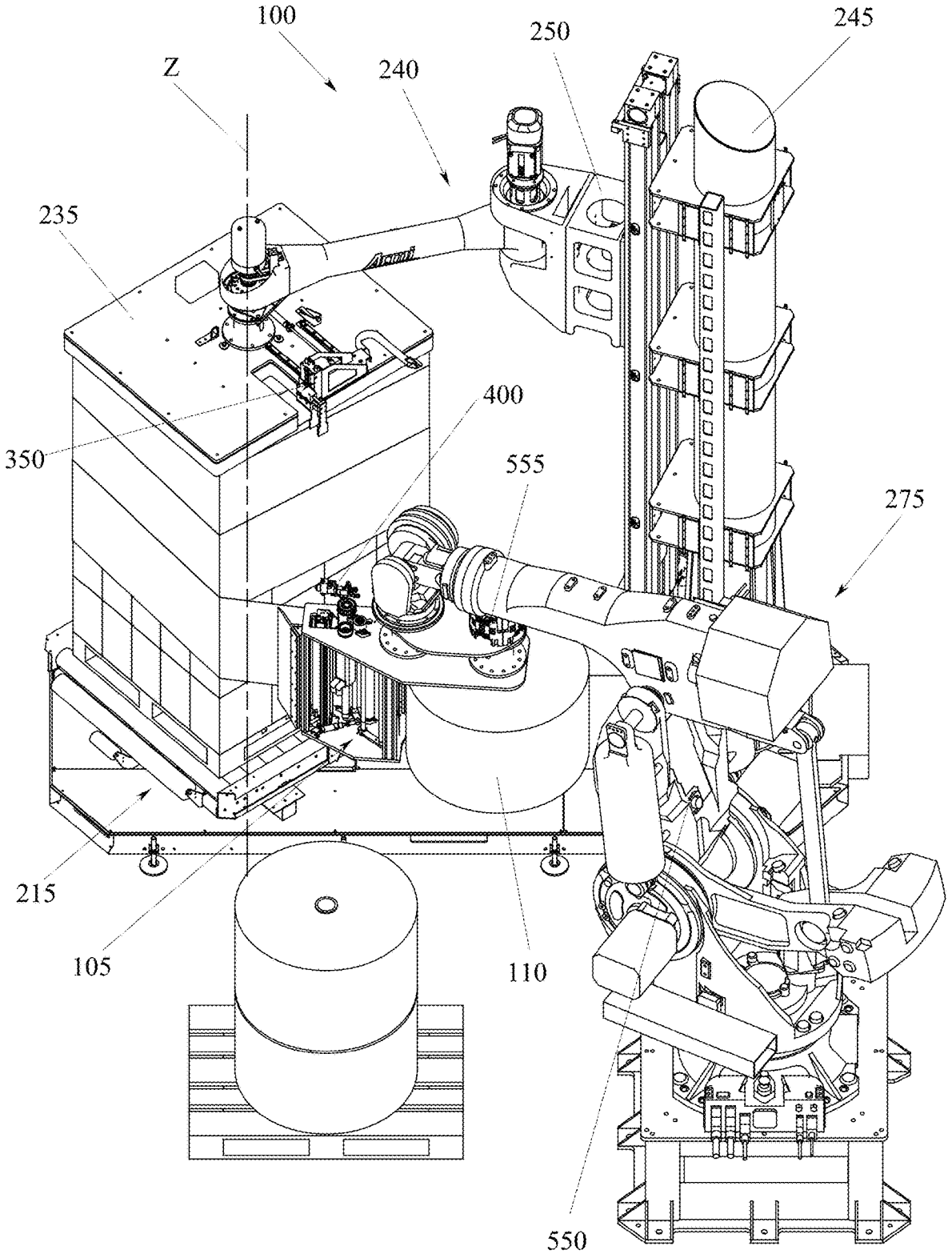
FIG. 18 is an axonometric view of a machine for stabilising palletised loads according to a fourth embodiment of the invention.
Figure 19:
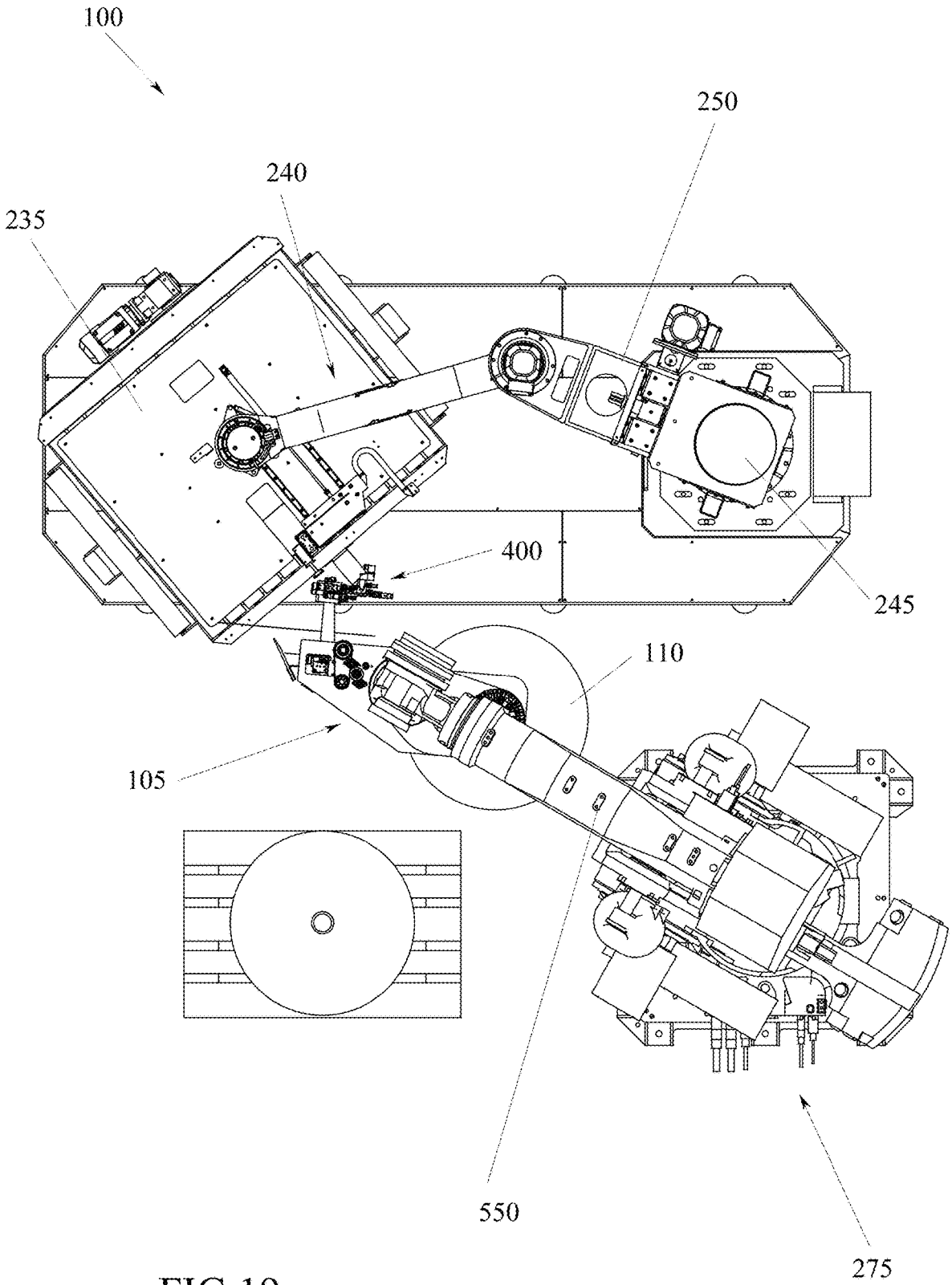
FIG. 19 is a top view of the machine of FIG. 18.
Figure 20:
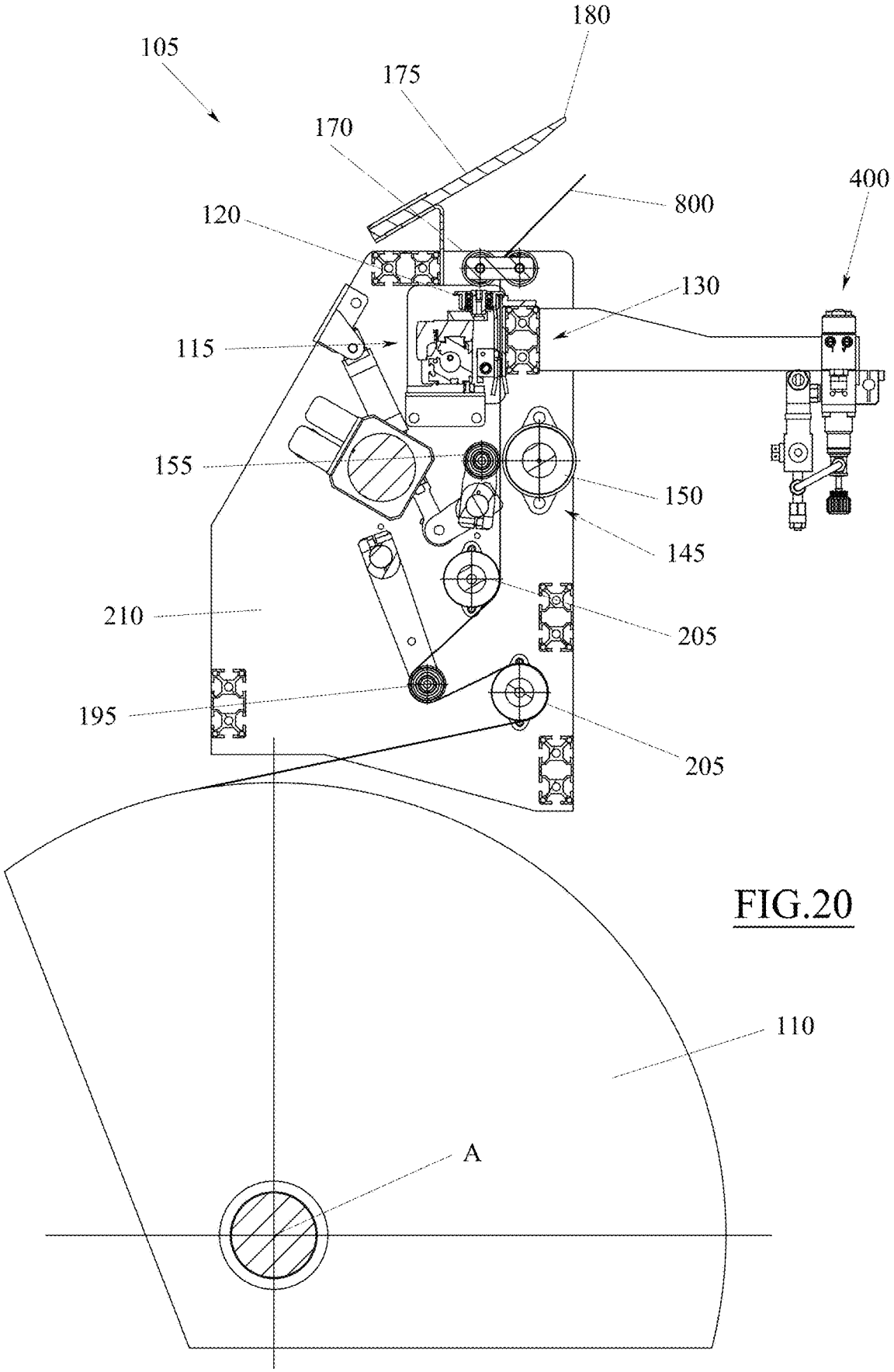
FIG. 20 is the section of the functional arrangement of the machine of FIG. 18 made according to the same sectional plane of FIG. 5.

The embodiment illustrated in FIGS. 18 to 20 differs from the previous ones, mainly due to the fact that the second movement apparatus 275 comprises a serial manipulator 550, having at least five or six axes, to whose terminal the functional arrangement 105 is connected.

In particular, the serial manipulator 550 can be of the industrial type and can therefore be suitable for bearing higher weights than those a SCARA robot such as those illustrated in the previous embodiments can carry.

This implies that the reel 110 installed in the functional arrangement 105 may be much larger, for example it may be one of the reels that are directly supplied by the manufacturer of the covering tape 800 (previously indicated with 505).

Due to the larger sizes, the reel 110 can be associated with a more performing braking device 555.

Regardless of the size of the reel 110 and of the corresponding braking device 555, the functional arrangement 105 is nevertheless similar to that described in the second embodiment.

In particular, it comprises a single rigid frame 210 on which the reel 110, the cutting device 115 and, possibly, the blocking device 130, the advancement device 145, the supporting rollers 170, the spatula 175, the return rollers 205 and the tensioning roller 195 are installed.

Also in this case, the functional arrangement 105 can in any case comprise an automatic system for hooking and unhooking the reel 110, to allow the rapid replacement of an exhausted reel 110 with another new reel 110, which can be previously placed on hold at a predetermined storage area.

Then, another difference of this embodiment consists in the fact that the fixing device 400, for example the adhesive dispensing guns 405 and/or 410, can be part of the functional arrangement 105, for example it can be installed on the rigid frame 210.

In this way it is not necessary to provide a third movement apparatus for the fixing device 400, which moves when driven by the second movement apparatus 275, together with the reel 110 and with the other devices of the functional arrangement 105.

The upper pad 235 is instead still carried by the respective lifting apparatus 240 which, in this case, is completely separated from the second movement apparatus 275.

Figure 21:
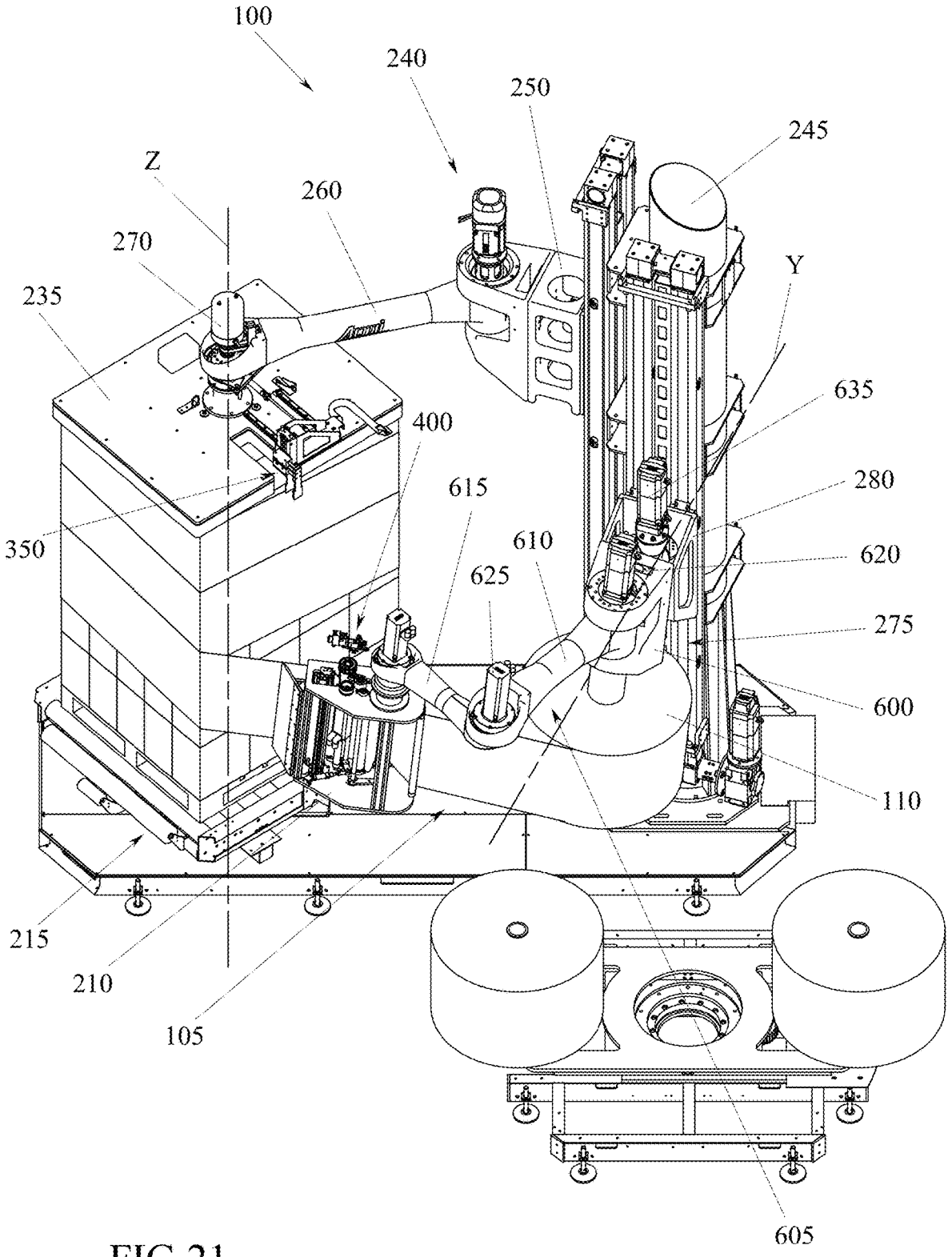
FIG. 21 is an axonometric view of a machine for stabilising palletised loads according to a fifth embodiment of the invention.
Figure 22:
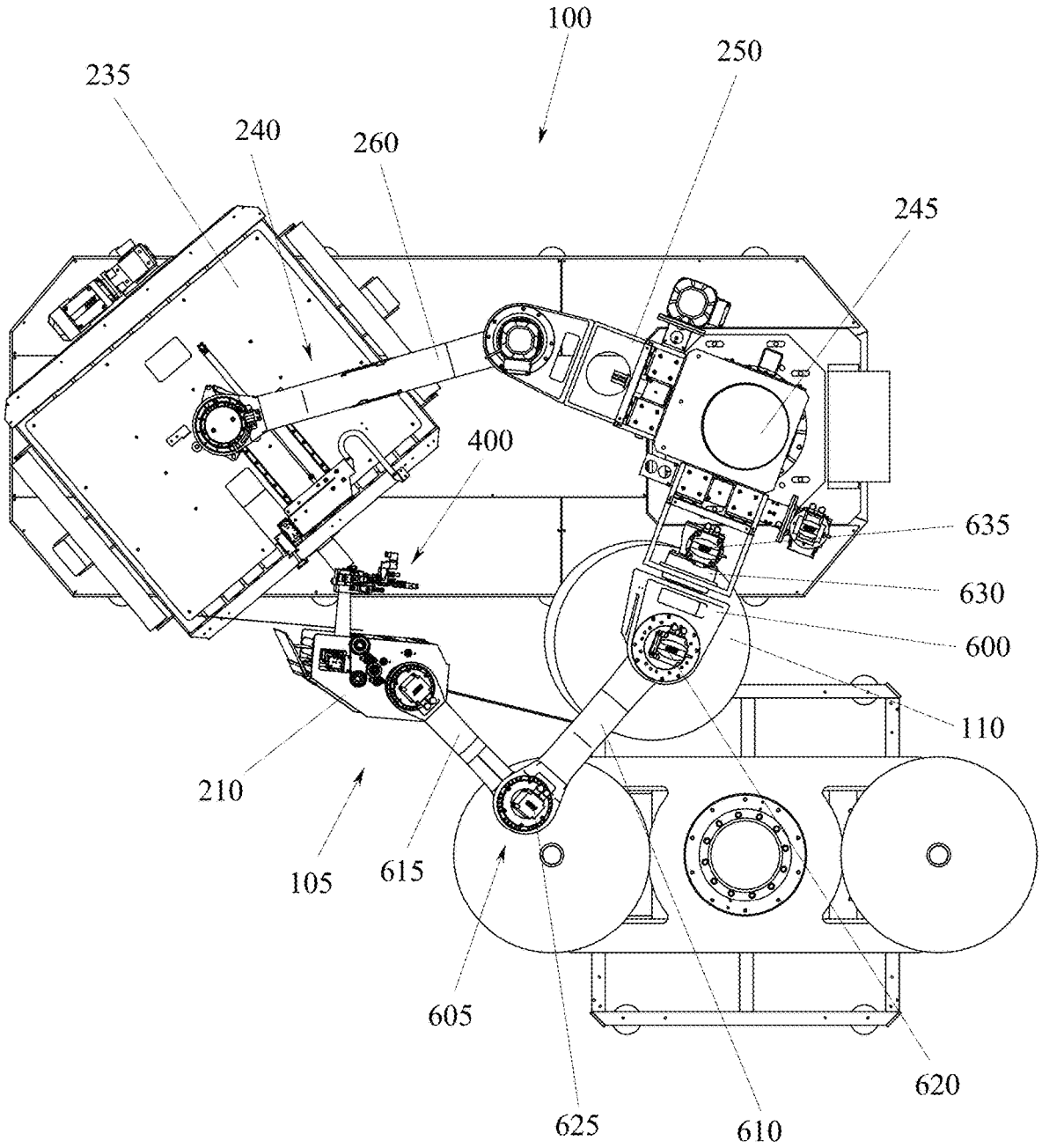
FIG. 22 is a top view of the machine of FIG. 21.
Figure 23:
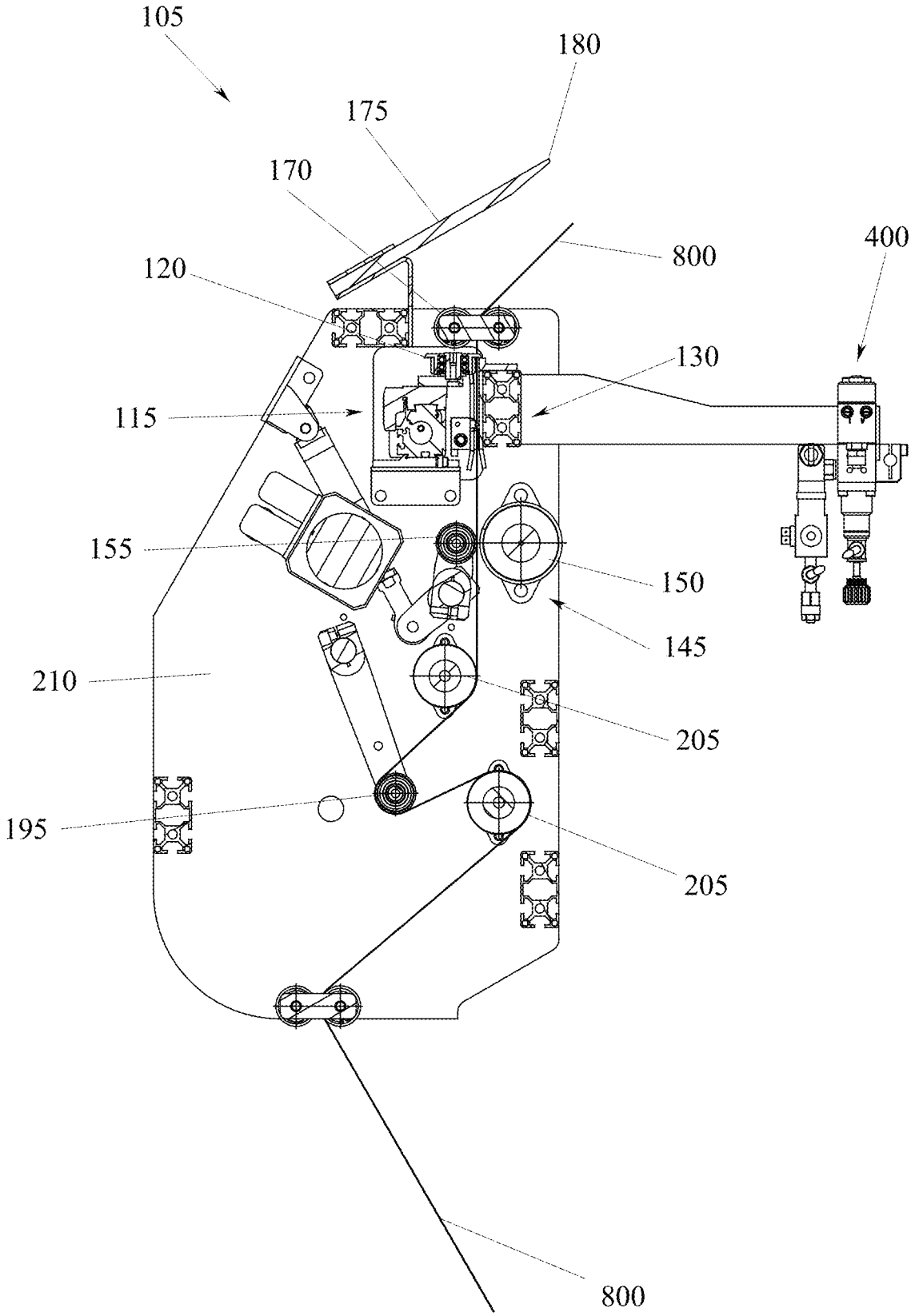
FIG. 23 is the section of the functional arrangement of the machine of FIG. 21 made according to the same sectional plane of FIG. 5.

The embodiment illustrated in FIGS. 21 to 23 differs from the previous one in that the functional arrangement 105 comprises two separate rigid frames, of which a first rigid frame 210 and a second rigid frame 600.

The cutting device 115 as well as, optionally, the blocking device 130, the advancement device 145, the supporting rollers 170, the spatula 175, the return rollers 205 and the tensioning roller 195 are installed on the first rigid frame 210. The fixing device 400 can also be installed on the first rigid frame 210.

On the second rigid frame 600, on the other hand, the reel 110 is installed with the relative braking device (if any), preferably through an automatic hooking and unhooking system, to allow it to be quickly replaced.

Also in this case, the reel 110 can be large sized, for example it can be one of the reels that are directly supplied by the manufacturer of the covering tape 800.

The first frame 210 and the second frame 600 can be connected by means of a connection arm 605.

The connection arm 605 can be an articulated arm entirely similar to the cantilevered arm 290 of the first embodiment.

In particular, the connection arm 605 can comprise two stretches in series, of which a first stretch 610 articulated to the second rigid frame 600 and a second stretch 615 articulated to the free end of the first stretch 610, with mutually parallel articulation axes.

The rotation of the first stretch 610 with respect to the second rigid frame 600 can be driven by an electric motor 620, while the rotation of the second stretch 615 with respect to the first stretch 610 can be driven by another independent electric motor 625.

The first rigid frame 210 can be connected to the connection arm 605, i.e. to the free end of the second stretch 615, by interposition of a joint adapted to define a single axis of mutual articulation, parallel to the articulation axis between the first stretch 610 and the second stretch 615.

As for the first embodiment, the second movement apparatus 275 can further comprise a supporting column, which can coincide with the supporting column 245 of the lifting apparatus 240 of the upper pad 235, and a carriage 280 connected to the functional arrangement 105, in this case to the second rigid frame 600, which is slidingly associated with said supporting column, so as to be able to slide vertically thereon, driven by suitable motors.

To allow the variation in orientation of the functional arrangement 105, and therewith of the reel 110, the second movement apparatus 275 can further comprise an articulated joint 630 (see FIG. 22) adapted to connect the carriage 280 to the second rigid frame 600 of functional arrangement 105, which is adapted to define the oscillation axis Y which, also in this case, is perpendicular to the revolution axis Z, i.e. preferably horizontal.

The rotation of the second rigid frame 600 with respect to the carriage 280 around said oscillation axis Y can be driven by a motor 635.

The operation of all the machines 100 described in relation to FIGS. 13 to 23 is similar to that described for the first embodiment.

Obviously, an expert in the field may make several technical-applicative modifications to all that above, without departing from the scope of the invention as hereinbelow claimed.

The invention claimed is:

1. A machine for stabilizing palletized loads, comprising:

a functional arrangement provided with a reel on which a covering tape is wound, a gripping device adapted to take a first end of the covering tape wound on the reel and to make it integral with the palletized load, a first movement apparatus adapted to generate a relative motion of revolution of the functional arrangement around the palletized load, according to a predetermined revolution axis, a second movement apparatus adapted to generate a relative motion of translation of the functional arrangement with respect to the palletized load in a direction parallel to the revolution axis, a cutting device placed in the functional arrangement so as to separate the covering tape from the reel, and a fixing device adapted to fix at least a second end of the covering tape to the palletized load, wherein the functional arrangement comprises a blocking device positioned between the reel and the cutting device, for selectively blocking the covering tape unwinding from the reel, wherein said blocking device comprises a pair of plates, at least one of which is movable with respect to the other between a distanced configuration, in which the covering tape passes with clearance between said plates, and a neared configuration, in which the covering tape is clamped between said plates.

2. The machine according to claim 1, wherein the covering tape is made of a cellulose-based material.

3. The machine according to claim 1, comprising a rest surface for the palletized load and an upper pad, superimposed on said rest surface and adapted to stay in contact with the top of the palletized load.

4. The machine according to claim 3, wherein the gripping device is installed on the upper pad.

5. The machine according to claim 3, wherein the first movement apparatus comprises a platform, which makes the rest surface available for the palletized load, and actuator members adapted to put the platform in rotation around a rotation axis coincident with the revolution axis.

6. The machine according to claim 1, wherein the gripping device comprises a gripper member adapted to seize the first end of the covering tape, the gripper member being adapted to remain integral with the palletized load, with respect to the relative motion of revolution of the reel around the palletized load.

7. The machine according to claim 6, wherein the gripping device comprises actuator members adapted to move said gripper member in a predetermined sliding direction towards and away from the revolution axis.

8. The machine according to claim 1, wherein the cutting device comprises at least one blade and actuator members adapted to move said blade with respect to the covering tape unwinding from the reel.

9. The machine according to claim 1, wherein the functional arrangement comprises an advancement device positioned between the reel and the cutting device, to unwind the covering tape from the reel and make it advance towards the cutting device.

10. The machine according to claim 9, wherein said advancement device comprises:

a motorized drive roller adapted to drag the covering tape coming from the reel, a contrast roller parallel to the drive roller, and actuator members adapted to create a relative movement of said drive roller and said contrast roller between a distanced configuration, in which the covering tape passes with clearance be-tween the drive roller and the contrast roller, and a neared configuration, in which the covering tape is clamped between the drive roller and the contrast roller.

11. The machine according to claim 1, wherein the functional arrangement comprises a brake for braking the rotation of the reel and/or a motor for putting the reel in rotation.

12. The machine according to claim 1, wherein the second movement apparatus is configured to allow a variation in the orientation of the functional arrangement by rotation around an oscillation axis perpendicular to the revolution axis.

13. The machine according to claim 12, wherein the second movement apparatus comprises:

a guide column, a carriage slidingly associated with said guide column in a direction parallel to the revolution axis, an articulated arm with parallel axes having a first end articulated to the carriage, and an articulated joint adapted to connect the rigid frame to the second end of the articulated arm, said articulated joint defining an articulation axis coincident with the oscillation axis.

14. The machine according to claim 1, wherein the functional arrangement comprises a single rigid frame connected to the second movement apparatus and on which both the reel and the cutting device are installed.

15. The machine according to claim 14, wherein the second movement apparatus comprises a serial manipulator to whose terminal the rigid frame is fixed.

16. The machine according to claim 1, wherein the functional arrangement comprises a first rigid frame carrying the cutting device, a second rigid frame carrying the reel, and an articulated arm with parallel axes having a first end articulated to the first rigid frame and a second end articulated to the second rigid frame.

17. The machine according to claim 16, wherein the second movement apparatus comprises:

a guide column, a carriage slidingly coupled to said guide column in a direction parallel to the revolution axis, and an articulated joint adapted to connect the carriage to the second rigid frame of the functional arrangement, said articulated joint defining an articulation axis coincident with the oscillation axis.

18. The machine according to claim 1, wherein said fixing device comprises at least one dispensing gun adapted to apply an adhesive between the second end of the covering tape and the palletized load.

19. The machine according to claim 1, wherein said fixing device is placed in the functional arrangement.

20. The machine according to claim 1, wherein said fixing device is associated with a third movement apparatus adapted to move it at least in a direction parallel to the revolution axis.

21. The machine according to claim 1, comprising at least two interchangeable functional arrangements, each of which is provided with a reel and with a cutting device, and a service apparatus adapted to house said functional arrangements.

22. The machine according to claim 1, comprising at least two interchangeable reels and a service apparatus adapted to house said reels.

23. A method for stabilizing palletized loads with the machine according to claim 1, comprising:

preparing a reel on which a covering tape is wound, taking a first end of the covering tape wound on the reel and making it integral with the palletized load, generating a relative motion of revolution of the reel around the palletized load, according to a predetermined revolution axis, generating a relative motion of translation of the reel with respect to the palletized load in a direction parallel to the revolution axis, separating the covering tape from the reel, fixing at least a second edge of the covering tape to the palletized load.

24. A machine for stabilizing palletized loads, comprising:

a functional arrangement provided with a reel on which a covering tape is wound, a gripping device adapted to take a first end of the covering tape wound on the reel and to make it integral with the palletized load, a first movement apparatus adapted to generate a relative motion of revolution of the functional arrangement around the palletized load, according to a predetermined revolution axis, a second movement apparatus adapted to generate a relative motion of translation of the functional arrangement with respect to the palletized load in a direction parallel to the revolution axis, a cutting device placed in the functional arrangement so as to separate the covering tape from the reel, and a fixing device adapted to fix at least a second end of the covering tape to the palletized load, wherein the covering tape is made of an inextensible cellulose-based material.

* * * * *